US006197723B1

(12) United States Patent
Gotoh

(10) Patent No.: US 6,197,723 B1
(45) Date of Patent: Mar. 6, 2001

(54) THERMOSENSITIVE RECORDING MATERIAL FOR LASER PRINTING AND IMAGE FORMING METHOD THEREFOR

(75) Inventor: Hiroshi Gotoh, Fuji (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 09/179,514

(22) Filed: Oct. 27, 1998

(30) Foreign Application Priority Data

| | | |
|---|---|---|
| Oct. 27, 1997 | (JP) | 9-309434 |
| Jan. 22, 1998 | (JP) | 10-024048 |
| Apr. 22, 1998 | (JP) | 10-126622 |
| Oct. 19, 1998 | (JP) | 10-313933 |

(51) Int. Cl.[7] ..... B41M 5/40

(52) U.S. Cl. ..... 503/201; 503/200; 503/214; 503/216; 503/226

(58) Field of Search ..... 503/200, 226, 503/201, 214, 216; 430/945

(56) References Cited

U.S. PATENT DOCUMENTS

| | | | |
|---|---|---|---|
| 5,380,693 | 1/1995 | Shimada et al. | 503/209 |
| 5,532,201 | 7/1996 | Goto | 503/213 |
| 5,712,221 | 1/1998 | Goto et al. | 203/226 |
| 5,739,077 * | 4/1998 | Goto et al. | 503/200 |
| 5,741,752 | 4/1998 | Goto et al. | 503/221 |

* cited by examiner

*Primary Examiner*—Bruce H. Hess
(74) *Attorney, Agent, or Firm*—Cooper & Dunham LLP

(57) ABSTRACT

A thermosensitive recording material including a transparent substrate; a thermosensitive recording layer which is formed overlying the substrate and which includes an electron donating coloring agent, an electron accepting color developer and a binder resin; and an overcoat layer which is formed overlying the recording layer and which includes a binder resin which has substantially the same refractive index as the recording material, wherein at least one of the recording layer and a layer adjacent to the recording layer includes a light-heat converting agent and the recording material has transmittance not less than about 10% in a range of from 360 to 420 nm in wavelength. The recording material on which images are recorded is useful for a block copy for flexography, gravure printing, offset printing and screen printing.

16 Claims, 3 Drawing Sheets

LIGHT ABSORBING PROPERTIES OF THERMOSENSITIVE RECORDING MATERIALS

LIGHT ABSORBING PROPERTIES OF THERMOSENSITIVE RECORDING MATERIALS

THERMOSENSITIVE RECORDING MATERIAL FOR LASER PRINTING AND IMAGE FORMING METHOD THEREFOR

BACKGROUND OF THE INVENTION

1. Field of the Invention

The present invention relates to a thermosensitive recording material utilizing a color forming reaction of an electron donating coloring agent and an electron accepting color developer and an image forming method therefor, and more particularly to a thermosensitive recording material for thermal recording using a laser which is useful as block copy films for flexography, gravure printing, offset printing and screen printing.

2. Discussion of the Related Art

Thermal recording is well known in which color images can be formed by imagewise heating with a thermal printhead a thermosensitive recording layer, or a protective layer formed on the recording layer, of a thermosensitive recording material. Such thermal recording is widely utilized for image forming apparatus such as facsimiles, printers for measuring instruments and the like. The thermal recording using a thermal printhead has the following drawbacks:

(1) undesired images such as white streaks and omissions of images tend to be formed on recording materials because dust easily adheres to thermal printheads or thermal printheads easily stick to the recording materials; and (2) thermal printheads are easily worn or damaged, resulting in deterioration of image qualities.

In particular, when a long image is recorded or many images are continuously recorded with a thermal plotter using a thermal printhead, it is almost impossible to obtain a good image or images without undesired images such as white streaks and omissions of images. In addition, thermal recording using a thermal printhead has drawbacks in that images having high resolution cannot be obtained and high speed recording is impossible because there are structural or physical limits of dot density and heating/cooling cycle times to heating elements of thermal printheads.

In addition, when thermosensitive recording materials in which images are formed are used as block copies for printing such as screen printing, it is especially desired to prevent the undesired images mentioned above from occurring and to improve image qualities such as resolution.

In attempting to solve these drawbacks of thermal recording using thermal printheads, Japanese Laid-Open Patent Publications Nos. 5-301447 and 9-20021 have disclosed thermal recording methods using a laser as a writing medium, which can produce images having high resolution at a high recording speed without touching the surface of a thermosensitive recording material.

However, the thermal recording method using a laser has a drawback in that good images cannot be obtained unless the output power of the laser is relatively large, because thermosensitive recording materials tend not to absorb near infrared light or infrared light of a laser. Therefore, it is difficult to provide a compact and low-cost thermal recording apparatus which uses a laser as a writing medium.

In attempting to solve the drawback of the thermal recording using a laser, thermosensitive recording materials are proposed which include a substance, which can effectively absorb the laser light, in a recording layer or a layer near the recording layer.

For example, Japanese Laid-Open Patent Publication No. 2-209290 discloses a thermosensitive recording material in which a light absorbing layer is formed on a recording layer; Japanese Laid-Open Patent Publications Nos. 3-86581 and 4-141485 disclose recording methods in which a laser irradiates a sheet which includes a light absorbing agent such as carbon black and which is overlaid on a thermosensitive recording material, to form images on the recording material; Japanese Laid-Open Patent Publications Nos. 4-357080 and 4-357082 disclose thermosensitive recording materials including a light absorbing agent which is microencapsulated; Japanese Laid-Open Patent Publication No. 2-120082 discloses a thermosensitive recording material including an infrared absorbing layer which is formed under a recording layer; and Japanese Laid-Open Patent Publications Nos. 5-278329, 6-72028, 7-186546, 8-187945, 8-90919, 8-127180, 8-187947, 8-258420 and 8-267920 disclose thermosensitive recording materials including a laser light converting material which can absorb laser light to convert the light energy to heat. However, images having good image qualities cannot be obtained by these recording materials or methods.

Laser light having a near infrared or infrared wavelength is typically used for thermal recording because recording materials color if a light absorbing substance absorbing visual light, i.e., a colored light absorbing substance, is used in the recording material. Therefore light absorbing agents used for recording materials for laser recording are limited and generally have high costs, resulting in increase of manufacturing costs of the recording materials. In addition, a problem tends to occur in that human eyes are damaged by infrared laser light because the laser light cannot be seen.

Because of these reasons, a need exists for a thermosensitive recording material which can produce images having good image qualities such as high resolution using a laser as a writing medium and which can preferably be used as block copies for printing.

SUMMARY OF THE INVENTION

Accordingly, an object of the present invention is to provide a thermosensitive recording material which can produce images having good image qualities such as high resolution at a high recording speed using a laser as a writing medium.

Another object of the present invention is to provide a transparent thermosensitive recording material which can produce images having good image density, particularly in an ultraviolet region (360–420 nm), which are useful as block copies for printing in which formed images can be easily checked even when a plurality of the block copies are laid overlapping each other.

Yet another object of the present invention is to provide a thermal recording method useful for recording on the thermosensitive recording materials mentioned above.

To achieve such objects, the present invention contemplates the provision of a transparent thermosensitive recording material which includes a transparent substrate, a thermosensitive recording layer including an electron donating coloring agent, an electron accepting color developer and a binder resin, and an overcoat layer including a resin which has substantially the same refractive index as the recording layer, wherein the recording layer or a layer adjacent to the recording layer has a light-heat converting function and the recording material has transmittance not less than about 10%, and preferably from about 50 to 100%, in a range of from 360 to 420 nm in wavelength.

Preferably the recording material has light absorbing properties in which absorbance has a peak value at a wavelength of from about 500 to about 550 nm, from about 780 to about 850 nm or from about 900 to about 1150 nm.

In another aspect of the present invention, a thermosensitive recording method is provided which includes the steps of:

providing the thermosensitive recording material mentioned above; and irradiating the recording material with a laser having a wavelength of from about 500 to about 550 nm or from about 780 to about 850 nm, or with a Nd:YAG laser, to form images on the recording material.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

The mechanism of the thermal recording using a laser is as follows:

(1) laser light, which is imagewise irradiated to a recording layer of a recording material, is absorbed by a light absorbing substance and converted to heat energy; and (2) coloring components (electron donating coloring agents and electron accepting color developers) included in the recording layer are reacted by the heat, resulting in formation of images on the recording material.

In order to improve the thermosensitivity of a recording material in thermal recording using a laser, key points are how to effectively convert light energy to heat energy and how to effectively transmit the heat to the coloring components.

The present invention provides a transparent thermosensitive recording material which includes a transparent substrate, a thermosensitive recording layer including an electron donating coloring agent, an electron accepting color developer and a binder resin, and an overcoat layer including a resin which has substantially the same refractive index as the recording layer, wherein the recording layer or a layer adjacent to the recording layer has a light-heat converting function and the recording material has transmittance not less than about 10%, and preferably from about 50 to 100%, in a range of from 360 to 420 nm in wavelength.

Figure 1:
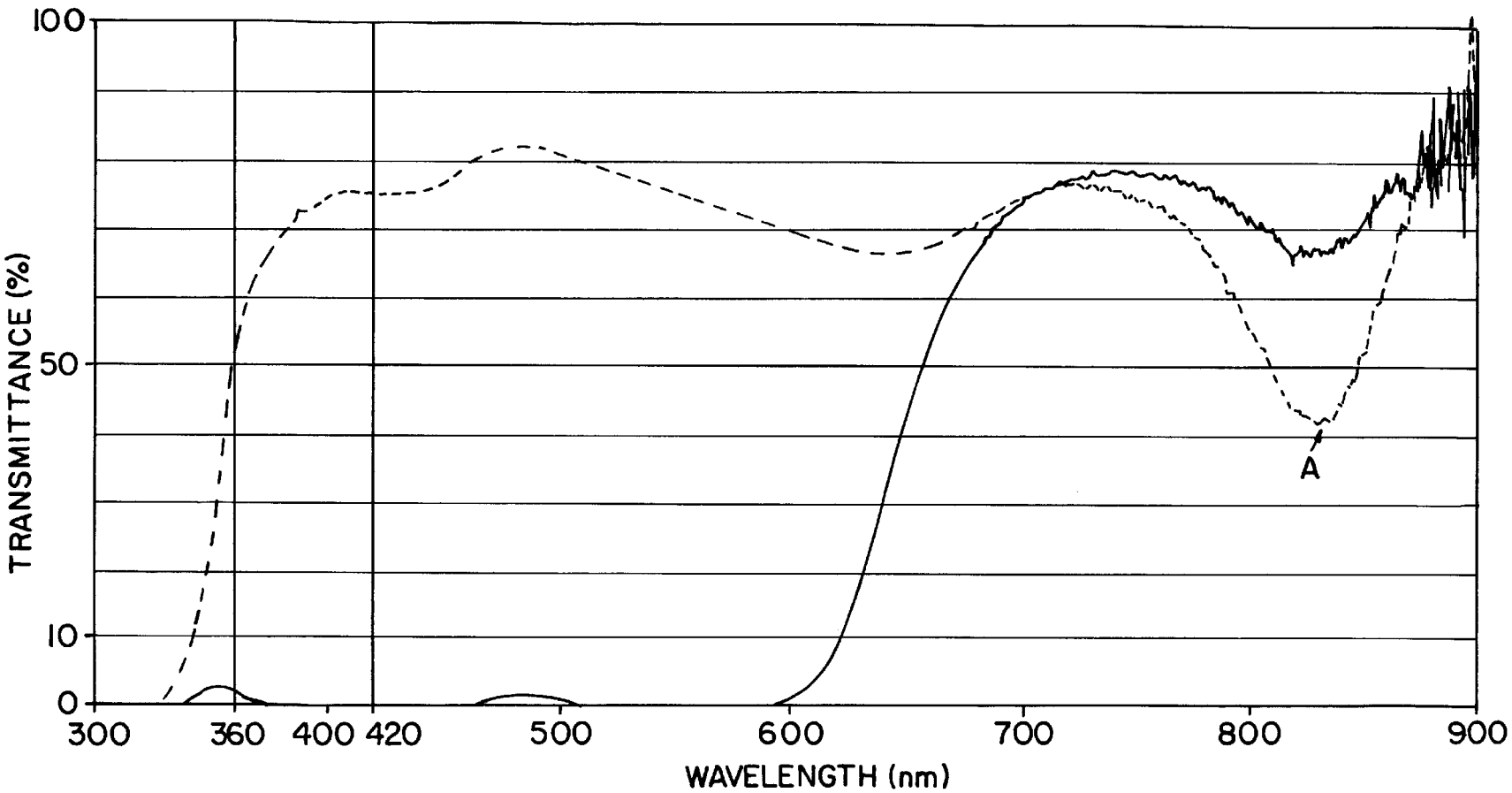
FIG. 1 is a graph illustrating light absorbing properties of an embodiment of the thermosensitive recording material of the present invention.

FIG. 1 is a graph illustrating light absorbing properties of an embodiment of the thermosensitive recording material of the present invention. In FIG. 1, transmittance of light is plotted on the vertical axis and wavelength of light is plotted on the horizontal axis. The solid line represents light absorbing properties of an image portion of the recording material and the dotted line represents light absorbing properties of a non-image portion thereof. Point A is a peak value of absorbance caused by a light-heat converting agent included in the recording material. This recording material has transmittance of from about 45 to about 75%. The light absorbing properties can be obtained using a spectrophotometer, for example, U3210 manufactured by Hitachi Ltd.

The recording material of the present invention preferably has light absorbing properties in which transmittance is not less than about 10% in a wavelength range of from 360 to 420 nm. This is because photosensitive resins for use in plates for flexography, gauzes for printing and pre-sensitized (PS) plates for offset printing are generally crosslinked by light of from 360 to 420 nm in wavelength. When a recording material which absorbs this ultraviolet light is used as a block copy, a good plate cannot be obtained due to poor contrast of an image portion and a background portion of a light image which is projected on the plate by the irradiation of the ultraviolet light.

Therefore a need exists for materials which have a light-heat conversion function and which have transmittance of not less than about 10% in a range of from 360 to 420 nm in wavelength.

Suitable materials for use as the light-heat conversion agents, which have light absorbing properties in which absorbance has a peak value at a wavelength of from 500 to 550 nm and in which transmittance is not less than about 10% in a range of from 360 to 420 nm in wavelength, include known direct dyes such as azo dyes; acid dyes such as azo dyes, anthraquinone dyes and metal complex azo dyes; basic dyes such as azo dyes, triphenylmethane dyes, azine dyes, oxazine dyes, thiazine dyes and xanthene dyes; vat dyes such as anthraquinone dyes; oil soluble dyes such as anthraquinone dyes, azo dyes and metal complex dyes; and disperse dyes such as azo dyes and anthraquinone dyes.

Specific examples of such dyes include OPLAS RED 330 (C.I. solvent red 111), OPLAS RED 339 (C.I. solvent red 135), OIL RED 5B (C.I. solvent red 27), OIL RED RR (C.I. solvent red 24), OIL RED OG (C.I. solvent red 1), OIL SCARLET 308 (C.I. solvent red 18), VALIFAST RED 2303, VALIFAST RED 3304 (C.I. solvent red 8), VALIFAST RED 3306, VALIFAST RED 3311, VALIFAST RED 3312 and VALIFAST RED 3320 (C.I. solvent red 132), each of which is manufactured by Orient Chemical Industries Co., Ltd.; SOT Pink-1 (C.I. solvent red 49) and SOT Red-3 (C.I. solvent red 18), each of which is manufactured by Hodogaya Chemical Co., Ltd.; MACROLEX Redviolet R (C.I. Disperse Violet 31) manufactured by Bayer Ltd.; Kayaset Red TD-FB R-504 (C.I. Disperse Red 60) manufactured by Nippon Kayaku Co., Ltd; TON MAGENTA 101, RED HM-1431, RED HM-1458 and Rubine REX-528, each of which is manufactured by Mitsui Toatsu Chemicals Inc.; and Oil Red (C.I. 26105), Oil Red AS (C.I. 26100), and Oil Red XO (C.I. 12140), each of which is manufactured by Tokyo Kasei Co., Ltd.

When such light-heat converting agents are used in a recording layer or a layer adjacent to the recording layer (such as an overcoat layer, an intermediate layer, an undercoat layer or a substrate) and a laser having a wavelength of from 500 to 550 nm irradiates the recording layer imagewise, images having good image qualities can be obtained. Specific examples of such a laser include green lasers such as argon lasers and YAG-SHG lasers. Among these lasers, YAG-SHG lasers using laser diodes are preferable because writing apparatus of compact size and capable of providing a high power laser output can be manufactured at relatively low cost.

Suitable materials for use as the light-heat converting agents, which have light absorbing properties in which absorbance has a peak value at a wavelength of from 780 to 850 nm and in which transmittance is not less than about 10% in a range of from 360 to 420 nm in wavelength, include known cyanine compounds such as polymethine compounds; phthalocyanine compounds; dithiol metal complex compounds; metal complex compounds; diimmmonium compounds; and aluminum salt compounds.

Specific examples of such compounds include NK-123, NK-2268, NK-2204, NK-78, NK-2882, NK-427, NK-2612, NK-2014, NK-4 and NK-2772, each of which is a cyanine compound and is manufactured by Nippon Photosensitive Dyes Co., Ltd.; PA-1005, SIR-128 and SIR-152, each of which is a metal complex compound and is manufactured by Mitsui Chemical Inc.; EX Color IR-1 and EX Color IR-2, each of which is a phthalocyanine dye and is manufactured by Nippon Shokubai Co., Ltd.; FD-3740 which is an indocyanine compound and is manufactured by Asahi Denka Kogyo Co., Ltd.; and IR-820B which is a polymethine compound and is manufactured by Nippon Kayaku Co., Ltd.

When such light-heat converting agents are used in a recording layer or a layer adjacent to the recording layer and a laser having a wavelength of from 780 to 850 nm irradiates the recording layer imagewise, images having good image qualities can be obtained. Specific examples of such a laser include semiconductor lasers such as GaAs semiconductor lasers. GaAs semiconductor lasers, which have a wavelength about 830 nm, are preferable because writing apparatus of compact size and capable of providing a high power laser output can be manufactured at relatively low cost.

Suitable materials for use as the light-heat conversion agents, which have light absorbing properties in which absorbance has a peak value at a wavelength of from 900 to 1150 nm and in which transmittance is not less than about 10% in a range of from 360 to 420 nm in wavelength, include known cyanine compounds; phthalocyanine compounds; dithiol metal complex compounds; metal complex compounds; diimmmonium compounds; and aluminum salt compounds.

Specific examples of such compounds include compounds shown in Tables 1 and 2.

TABLE 1

| No | Name of dye (λ max)* | Manufacturer | Formula |
|---|---|---|---|
| 1 | NK-2545 (1010 nm) | Nippon Photosensitive Dyes Co., Ltd. | Cyanine compound |
| 2 | NK-3508 (1060 nm) | Nippon Photosensitive Dyes Co., Ltd. | 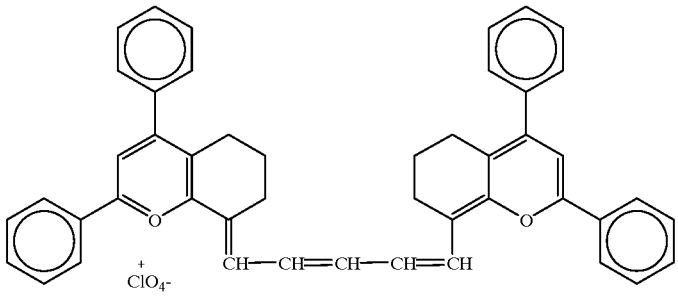 |
| 3 | NK-3509 (1060 nm) | Nippon Photosensitive Dyes Co., Ltd. | Cyanine compound |
| 4 | NK-3519 (1060 nm) | Nippon Photosensitive Dyes Co., Ltd. | Cyanine compound |
| 5 | NK-3555 (1060 nm) | Nippon Photosensitive Dyes Co., Ltd. | Cyanine compound |
| 6 | NK-2674 (943 nm) | Nippon Photosensitive Dyes Co., Ltd. | 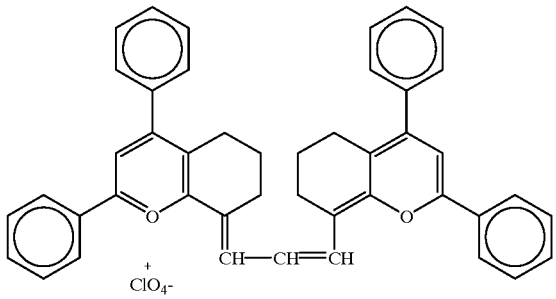 |

TABLE 1-continued

| No | Name of dye (λ max)* | Manufacturer | Formula |
|---|---|---|---|
| 7 | NIR-AM1 (980 nm) | Teikoku Chemical Industries Co., Ltd. | 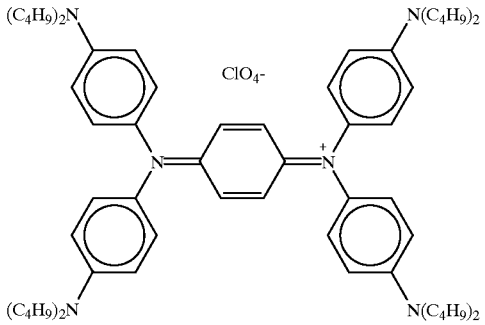 |

*λ max: a wavelength at which absorbance has a maximum value

TABLE 2

| No | Name of dye (λ max)* | Manufacturer | Formula |
|---|---|---|---|
| 8 | SIR-132 (1039 nm) | Mitsui Chemicals Inc. | Metal complex compound |
| 9 | PA-1001 (1110 nm) | Mitsui Chemicals Inc. | Metal complex compound |
| 10 | PA-1006 (925 nm) | Mitsui Chemicals Inc. | 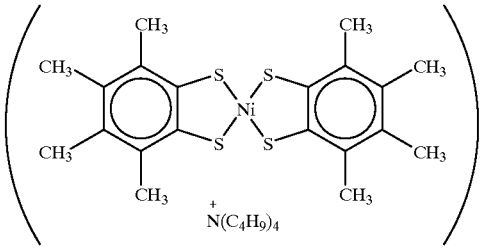 |
| 11 | IRG-003 (980 nm) | Nippon Kayaku Co., Ltd. | Aluminum compound |
| 12 | IRG-002 (1090 nm) | Nippon Kayaku Co., Ltd. | Diimmonium compound |
| 13 | — (1090 nm) | A.C.C | 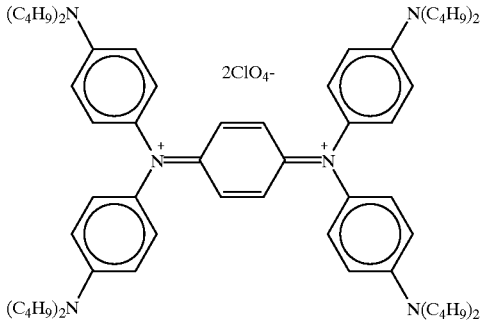 |

TABLE 2-continued

| No | Name of dye (λ max)* | Manufacturer | Formula |
|---|---|---|---|
| 14 | — (980 nm) | A.C.C | 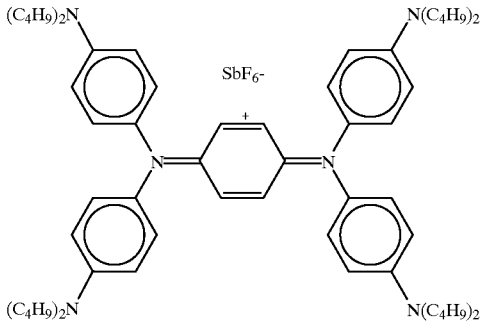 |

*λ max: a wavelength at which absorbance has a maximum value

When such light-heat converting agents are used in a recording layer or a layer adjacent to the recording layer and a laser having a wavelength of from 900 to 1150 nm irradiates the recording layer imagewise, images having good image qualities can be obtained. Specific examples of such a laser include semiconductor lasers such as Nd:YAG lasers. Nd:YAG lasers using laser diodes are preferable because writing apparatus of compact size and capable of providing a high power laser output can be manufactured at relatively low cost.

The content of the dyes mentioned above is preferably from about 0.01 to about 1% by weight in the thermosensitive recording material.

Since a transparent recording material is used, a laser can irradiate it from the side of a recording material on which a recording layer including a light-heat converting agent is formed or from the opposite side of the recording material.

The recording layer of the recording material of the present invention includes an electron donating coloring agent (hereinafter coloring agent). Suitable coloring agents for use in the recording layer include known colorless or pale-colored dye precursors.

Specific examples of such dye precursors include the following compounds but are not limited thereto:

3-diethylamino-7-anilinofluoran, 3-di-n-butylamino-7-anilinofluoran, 3-(N-n-hexyl-N-ethylamino)-7-anilinofluoran, 3-diethylamino-7-dibenzylaminofluoran, 3-diethylamino-5-methyl-7-dibenzylaminofluoran, 3-diethylamino-7-piperidinofluoran, 3-diethylamino-7-(o-chloroanilino) fluoran, 3-di-n-butylamino-7-(o-chloroanilino)fluoran, 3-dimethylamino-6-methyl-7-anilinofluoran, 3-diethylamino-6-methyl-7-anilinofluoran, 3-di-n-butylamino-6-methyl-7-anilinofluoran, 3-(N-n-propyl-N-methylamino)-6-methyl-7-anilinofluoran, 3-(N-isopropyl-N-methylamino)-6-methyl-7-anilinofluoran, 3-(N-n-butyl-N-ethylamino)-6-methyl-7-anilinofluoran, 3-(N-isobutyl-N-methylamino)-6-methyl-7-anilinofluoran, 3-(N-n-amyl-N-methylamino)-6-ethyl-7-anilinofluoran, 3-(N-isoamyl-N-ethylamino)-6-methyl-7-anilinofluoran, 3-(N-cyclohexyl-N-methyl)-6-methyl-7-anilinofluoran, 3-(N-n-amyl-N-ethyamino)-6-methyl-7-anilinofluoran, 3-(N-n-tolyl-N-ethylamino)-6-methyl-7-anilinofluoran, 3-(N-2-ethoxypropyl-N-ethylamino)-6-methyl-7-anilinofluoran, 3-pyrrolidino-6-methyl-7-anilinofluoran, 3-(N-tetrahydrofurfuryl-N-ethylamino)-6-methyl-7-anilinofluoran, 3-diethylamino-7-(m-trifluoromethylanilino)fluoran, 3-diethylamino-6-methyl-7-(2',4'-dimethylanilino) fluoran, 3-diethylamino-6-chloro-7-anilinofluoran, 3-diethylamino-5-methyl-7- (α-phenylethylamino) fluoran, 3-(N-p-tolyl-N-ethylamino)-7-(α-phenylethylamino) fluoran, and the like.

More preferable coloring agents include fluoran compounds having one of the following formulas (III) to (VIII) and fluoran compounds shown in Table 3.

(III)

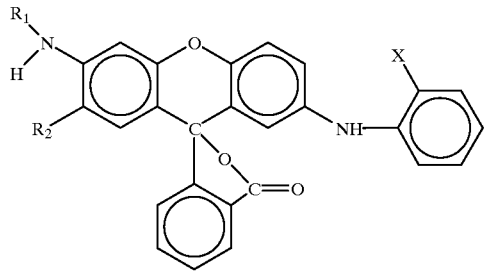

wherein $R_1$ represents an alkyl group having 8 or less carbon atoms; $R_2$ represents a hydrogen atom or an alkyl group having 4 or less carbon atoms; and X represents a halogen atom such as fluorine, chlorine, bromine and the like.

(IV)

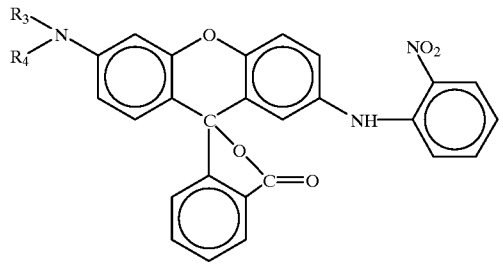

wherein $R_3$ represents a hydrogen atom or an alkyl group having 8 or less carbon atoms; and $R_4$ represents an alkyl group having 8 or less carbon atoms.

(V)

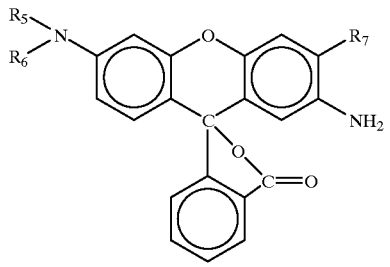

wherein $R_5$ and $R_6$ independently represent an alkyl group having 8 or less carbon atoms; and $R_7$ represents a hydrogen atom, a lower alkyl group or a lower alkoxy group.

(VI)

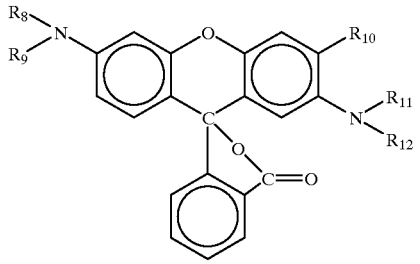

wherein $R_8$ represents a hydrogen atom; $R_9$ represents an alkyl group having 8 or less carbon atoms; $R_{10}$ represents a hydrogen atom, a lower alkyl group or a lower alkoxy group; $R_{11}$ represents a hydrogen atom or an alkyl group having 8 or less carbon atoms; and $R_{12}$ represents an alkyl group having 8 or less carbon atoms, a phenyl group or a substituted phenyl group.

(VII)

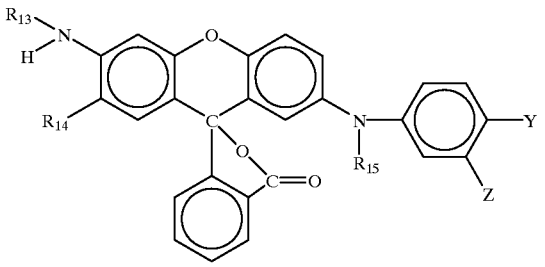

wherein $R_{13}$ represents an alkyl group having 8 or less carbon atoms; $R_{14}$ represents a methyl group or an ethyl group; $R_{15}$ represents a hydrogen atom or an alkyl group having 4 or less carbon atoms; and Y and Z independently represent a hydrogen atom or a halogen atom such as fluorine, chlorine, bromine and the like.

(VIII)

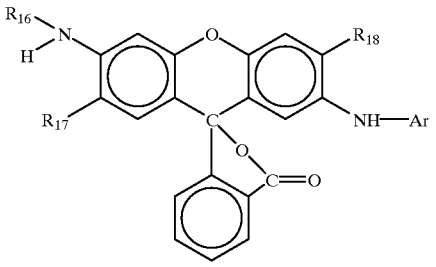

wherein $R_{16}$ represents an alkyl group having 8 or less carbon atoms; $R_{17}$ represents a methyl group or an ethyl group; $R_{18}$ represents a hydrogen atom or an alkyl group having 4 or less carbon atoms; Y and Z independently represent a hydrogen atom or a halogen atom such as fluorine, chlorine, bromine and the like; and Ar represents a phenyl group or a benzyl group.

Specific examples of the compounds having formula (III) include the following compounds:

2-(o-chlorophenylamino)-6-ethylamino-7-methylfluoran, 2-(o-chlorophenylamino)-6-n-butylamino-7-methylfluoran, 2-(o-fluorophenylamino)-6-ethylamino-7-methylfluoran, 2-(o-chlorophenylamino)-6-n-butylaminofluoran, 2-(o-chlorophenylamino)-6-n-hexylaminofluoran, 2-(o-chlorophenylamino)-6-n-octylaminofluoran, 2-(o-fluorophenylamino)-6-isoamylaminofluoran, and 2-(o-fluorophenylamino)-6-n-octylaminofluoran.

Specific examples of the compounds having formula (IV) include the following compounds:

2-(o-nitrophenylamino)-6-diethylaminofluoran, 2-(o-nitrophenylamino)-6-di-n-butylaminofluoran, 2-(o-nitrophenylamino)-6-(N-ethyl-N-n-butylamino) fluoran, and 2-(o-nitrophenylamino)-6-(N-ethyl-N-isoamylamino) fluoran.

Specific examples of the compounds having formula (V) include the following compounds:

2-amino-6-diethylaminofluoran, 2-amino-6-di-n-butylaminofluoran, 2-amino-3-methyl-6-diethylaminofluoran, 2-amino-3-methyl-6-di-n-butylaminofluoran, 2-amino-3-methyl-6-(N-ethyl-N-isoamylamino)fluoran, 2-amino-3-methoxy-6-diethylaminofluoran, and 2-amino-3-methoxy-6-di-n-butylaminofluoran.

Specific examples of the compounds having formula (VI) include the following compounds: 2-methylamino-6-n-butylaminofluoran, 2-n-butylamino-6-n-butylaminofluoran, 2-n-octylamino-6-ethylaminofluoran, 2-n-octylamino-3-methyl-6-n-butylaminofluoran, 2-phenylamino-6-ethylaminofluoran, 2-phenylamino-6-n-butylaminofluoran, 2-phenylamino-6-n-octylaminofluoran, 2-phenylamino-3-methyl-6-n-butylaminofluoran, 2-phenylamino-3-methyl-6-ethylaminofluoran, 2-phenylamino-3-methyl-6-n-hexylaminofluoran, 2-phenylamino-3-methyl-6-n-amylaminofluoran, 2-phenylamino-3-methyl-6-isoamylaminofluoran, 2-phenylamino-3-methyl-6-n-octylaminofluoran, 2-phenylamino-3-methoxy-6-n-butylaminofluoran, and 2-phenylamino-3-methoxy-6-n-hexylaminofluoran.

Specific examples of the compounds having formula (VII) include the following compounds:

2-(3', 4'-dichlorophenylamino)-6-ethylamino-7-methylfluoran, 2-(3',4'-dichlorophenylamino)-6-n-butylamino-7-methylfluoran, 2-(3'-chloro-4'-fluorophenylamino)-6-ethylamino-7-methylfluoran, 2-(N'-methyl-N-3'-chlorophenylamino)-6-ethylamino-7-methylfluoran, 2-(N-ethyl-N-3'-chlorophenylamino)-6-ethylamino-7-methylfluoran, and 2-(N-methyl-N-4'-chlorophenylamino)-6-ethylamino-7-methylfluoran.

Specific examples of the compounds having formula (VIII) include the following compounds:

2-phenylamino-3-methyl-6-ethylamino-7-methylfluoran, 2-phenylamino-3-methyl-6-n-butylamino-7-methylfluoran, 2-phenylamino-3-ethyl-6-ethylamino-7-methylfluoran, 2-benzylamino-3-methyl-6-ethylamino-7-methylfluoran, 2-phenylamino-3-chloro-6-ethylamino-7-methylfluoran, 2-phenylamino-3-chloro-6-n-butylamino-7-methylfluoran, and 2-benzylamino-3-chloro-6-ethylamino-7-methylfluoran.

TABLE 3

(1)

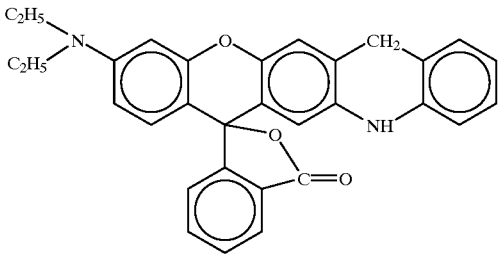

(2)

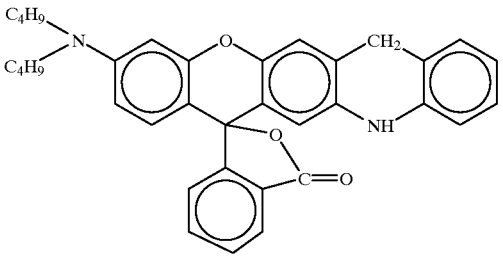

(3)

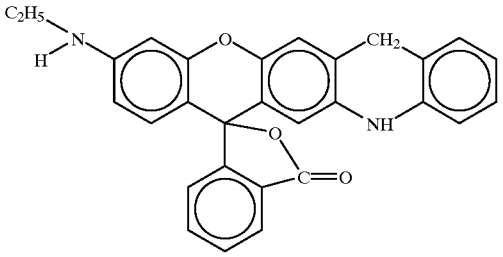

(4)

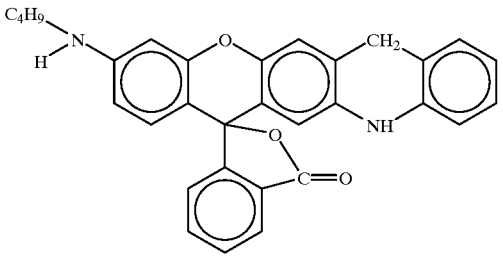

TABLE 3-continued (5)

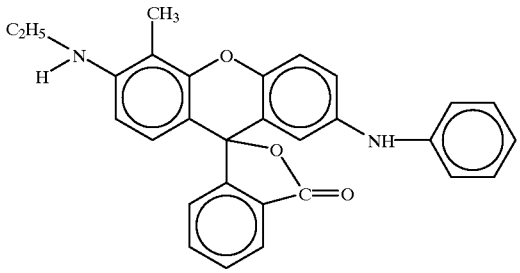

(6)

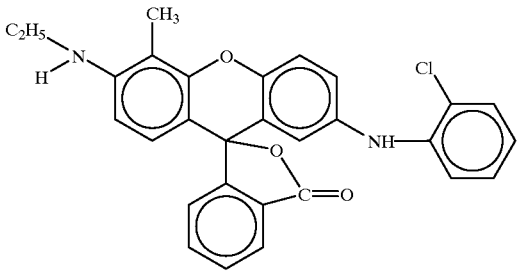

(7)

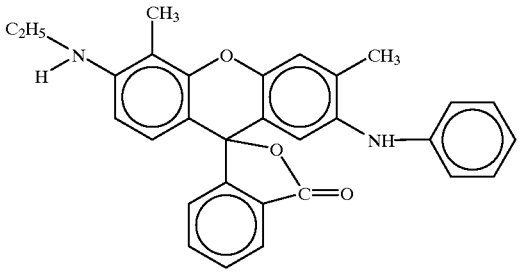

(8)

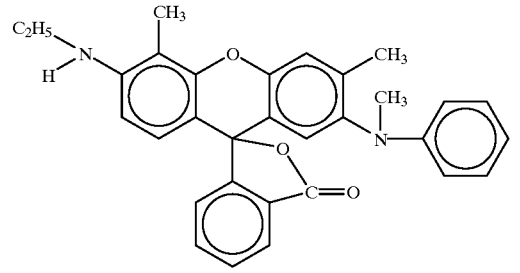

(9)

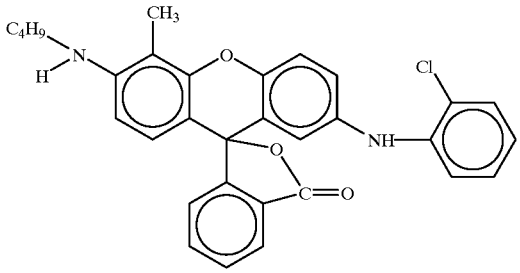

TABLE 3-continued
(10)
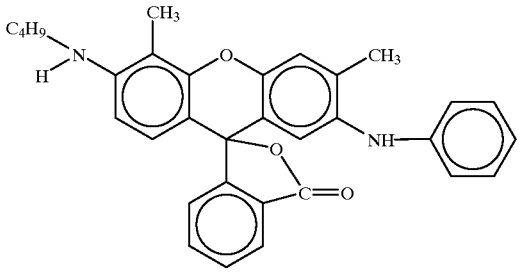
(11)
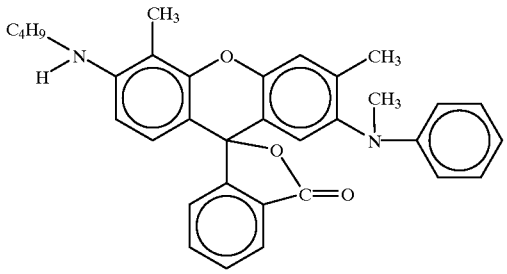
(12)
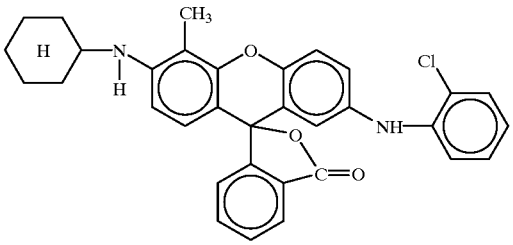
(13)
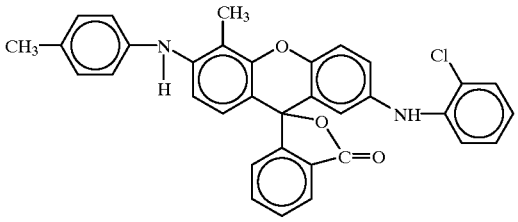
(14)
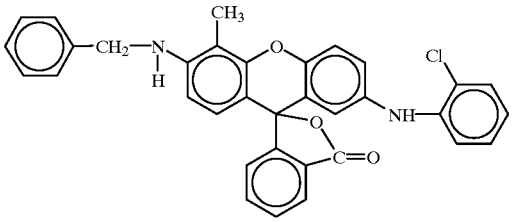
(15)
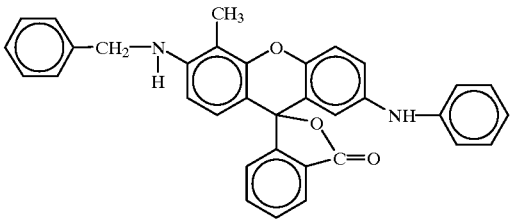
TABLE 3-continued
(16)
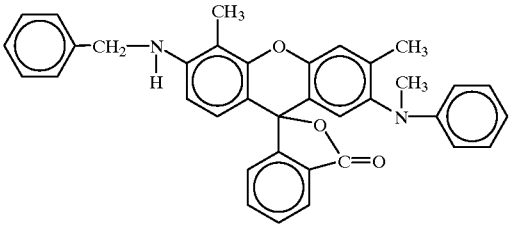
(17)
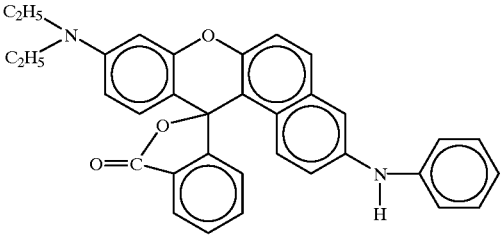
(18)
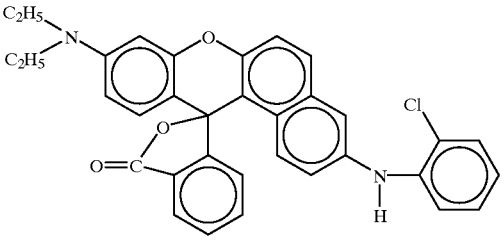
(19)
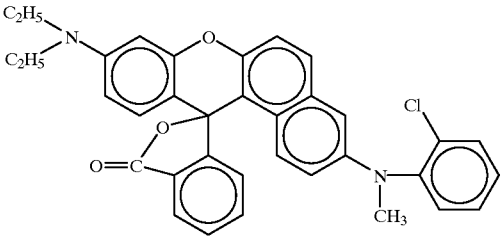
(20)
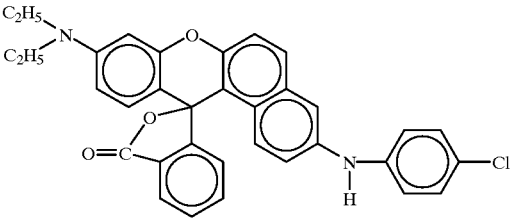
(21)
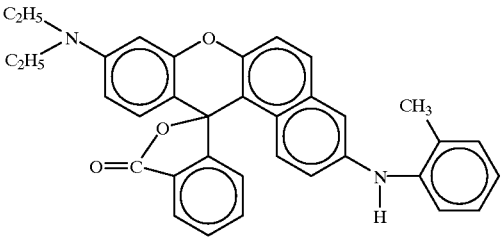

TABLE 3-continued (22)

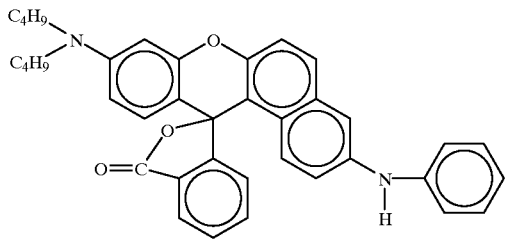

(23)

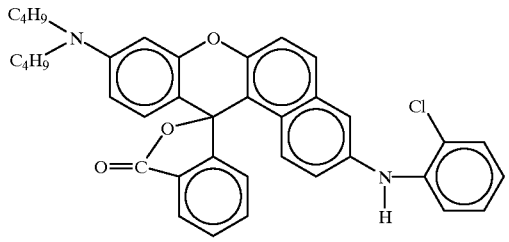

(24)

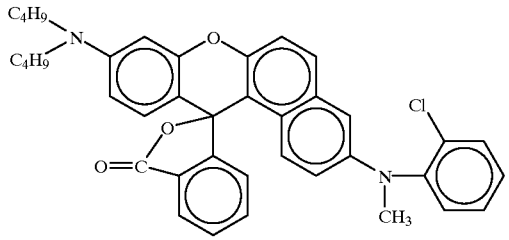

These coloring agents can be used alone or in combination.

Suitable electron accepting color developers for use in the recording material of the present invention, which make the coloring agents mentioned above colored, include phenolic compounds and organic phosphoric acid compounds which are hardly soluble or are not soluble in general solvents.

Specific examples of such phenolic compounds include gallic acid compounds, protocatechuic acid compounds, bis(hydroxyphenyl)acetic acid compounds and the like.

Specific examples of such organic phosphoric acid compounds include alkylphosphonic acid compounds, α-hydroxyalkylphosphonic acid compounds and the like.

Among these compounds, organic phosphoric acid compounds are preferable because the resultant thermosensitive recording material can produce good images by low heat energy.

More preferably, the organic phosphoric acid compounds having the following formula (I) or (II) can be used:

(I)

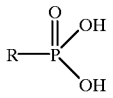

wherein R represents a linear alkyl group having from 16 to 24 carbon atoms; and (II)

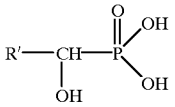

wherein R' represents a linear alkyl group having from 13 to 23 carbon atoms.

Specific examples of the compounds having formula (I) include hexadecylphosphonic acid, octadecylphosphonic acid, eicosylphosphonic acid, docosylphosphonic acid, tetracosylphosphonic acid, and the like.

Specific examples of the compounds having formula (II) include:

α-hydroxytetradecylphosphonic acid, α-hydroxyhexadecylphosphonic acid, α-hydroxyoctadecylphosphonic acid, α-hydroxyeicosylphosphonic acid, α-hydroxytetracosylphosphonic acid, and the like.

These color developers can be used alone or in combination.

The average particle diameter of the color developer for use in the recording layer of the recording material of the present invention is preferably not greater than about 10 μm, and more preferably not greater than 1 μm while particles greater than 1 μm are not included, to obtain a recording material having high thermosensitivity and high resolution.

Suitable binder resins for use in the recording layer include resins which can keep colored materials stable, which are formed by a ring-opening-reaction of the coloring agents mentioned above by attack of protons of the color developers mentioned above upon application of heat, by making the colored materials be in a state rich in protons. In addition, it is preferable for the binder resins to hardly erase the colored materials. For example, resins having a hydroxy group or a carboxyl group and in addition having a refractive index of from about 1.45 to about 1.60 at room temperature are preferable for the binder resin.

Specific examples of such resins for use as the binder resin include polyvinyl butyral resins (refractive index of from 1.48 to 1.49), polyvinyl acetal resins (refractive index of 1.50), epoxy resins (refractive index of from 1.55 to 1.61), ethyl cellulose (refractive index of from 1.46 to 1.49), cellulose acetate (refractive index of from 1.46 to 1.50), cellulose acetate butyrate (refractive index of from 1 .46 to 1.49), cellulose acetate propionate (refractive index of from 1.46 to 1 .49), nitrocellulose (refractive index of from 1.49 to 1.51), styrene-maleic acid copolymers (refractive index of from 1.50 to 1.60) and the like. In addition, acidic compounds which are included as impurities in the binder resins, and ultraviolet absorbing agents and antioxidants, which include a hydroxy group or a carboxyl group and which are mentioned later, also have the same functions as the binder resins mentioned above.

Further the light resistance of the recording material of the present invention can be improved by including a photostabilizer in the recording layer or in an overcoat layer which is formed on the recording layer. Suitable photostabilizers for use in the present invention include ultraviolet absorbing agents, antioxidants, quenchers having oxygen of a singlet state, and superoxide anion type quenchers.

Specific examples of the ultraviolet absorbing agents include, but are not limited to, benzophenone type ultraviolet absorbing agents such as 2,4-dihydroxybenzophenone, 2-hydroxy-4 -methoxybenzophenone, 2-hydroxy-4-n-octoxybenzophenone, 4-dodecyloxy-2-hydroxybenzophenone, 2,2'-dihydroxy-4-methoxybenzophenone, 2,2'-dihydroxy-4,4'-dimethoxybenzophenone, 2,2',1,4'-tetrahydroxybenzophenone, 2-hydroxy-4-methoxy-2'-carboxybenzophenone, 2-hydroxy-4-oxybenzylbenzophenone, 2-hydroxy-4-chlorobenzophenone, 2-hydroxy-5 -chlorobenzophenone, 2-hydroxy-4-methoxy-4'-methylbenzophenone, 2-hydroxy-4-n-heptoxybenzophenone, 2-hydroxy-3,6 -dichloro-4-methoxybenzophenone, 2-hydroxy-3,6-dichloro-4-ethoxybenzophenone, and 2-hydroxy-4-(2-hydroxy-3-methylacryloxy)propoxybenzophenoene; benzotriazole type ultraviolet absorbing agents such as 2-(2'-hydroxy-5'-methylphenyl) benzotriazole, 2-(2'-hydroxy-3',5'-di-tert-butylphenyl) benzotriazole, 2-(2'-hydroxy-3'-tert-butyl-5'-methylphenyl) benzotriazole, 2-(2'-hydroxy-4'-oxtoxy) benzotriazole, 2-(2'-hydroxy-3',5'-di-tert-butylphenyl)-5-chlorobenzotriazole, 2-(3'-tert-butyl-2'-hydroxy-5'-mehtylphenyl)-5-chlorobenzotriazole, and 2-(2'-hydroxy-5-ethoxyphenyl)benzotriazole; salicylic acid phenyl ester type ultraviolet absorbing agents such as phenyl salicylate, p-octylphenyl salicylate, p-tert-butylphenyl salicylate, carboxyphenyl salicylate, methylphenyl salicylate, and dodecylphenyl salicylate; p-methoxybenzylidenemalonic acid dimethyl ester; 2-ethylhexyl-2 -cyano-3,3'-diphenyl acrylate; ethyl-2-cyano- 3,3'-diphenyl acrylate; 3,5-di-tert-butyl-p-hydroxybenzoic acid; and resorcinol monobenzoate, 2,4'-di-tert-butylphenylbenzoate, and 3,5-di-tert-butyl-4-hydroxyphenylbenzoate, each of which can be rearranged by irradiation with ultraviolet light.

Specific examples of the antioxidants include, but are not limited to, 2,6-di-tert-butyl-4-methylphenol, 2,4,6,-tri-tert-butylphenol, styrenated phenol, 2,2'-methylenebis(4-methyl-6-tert-butylphenol), 4,4'-isopropylidenebisphenol, 2,6-bis (2'-hydroxy-3'-tert-butyl-methylbenzyl)-4-methylphenol, 4,4'-thiobis(3-methyl-6-tert-butylphenol), tetrakis{methylene(3,5-ditert-butyl-4-hydroxyhydrocinnamate)}methane, p-hydroxyphenyl-3-naphthylamine, 2,2,4-trimethyl-1,2-dihydroxyquinoline, thiobis (β-naphthol), mercaptobenzothiazole, mercaptobenzimidazole, aldol-2-naphthlamine, bis (2,2,6,6-tetramethyl-4-piperidyl) sebacate, 2,2,6,6-tetramethyl-4-piperidylbenzoate, dilauryl-3,3'-thiodipropionate, distearyl-3,3'-thiodipropionate, and tris(4-nonylphenol) phosphite.

Suitable quenchers having oxygen of a singlet state include, but are not limited to, carotenes, dyes, amines, phenols, nickel complexes, sulfides and the like. Specific examples of such quenchers include 1,4-diazabicyclo (2,2,2)octane, β-carotene, 1,3-cyclohexadiene, 2-diethylaminomethylfuran, 2-phenylaminomethylfuran, 9-diethylaminomethylanthracene, 5-diethylaminomethyl-6-phenyl-3,4-dihydroxypyran, nickel dimethyl dithiocarbamate, nickel dibutyl dithiocarbamate, nickel 3,5-di-tert-butyl-4-hydroxybenzyl-o-ethylphosphonate, nickel 3,5-di-tert-butyl-4-hydroxybenzyl-o-butylphosphonate, nickel {2,2'-thiobis(4-tert-octylphenolate)}(n-butylamine), nickel {2,2'-thiobis(4-tert-octylphenolate)}(2-ethylhexylamine), nickel bis{2,2'-thiobis (4-tert-octylphenolate)}, nickel bis{2,2'-sulfonebis(4-octylphenolate)}, nickel bis{2-hydroxy-5-methoxyphenyl-N-n-butylaldoimine), nickel bis(dithiobenzyl), and nickel bis(dithiobiacetyl).

Specific examples of the superoxide anion type quenchers include superoxide dismutase, complexes of cobalt [III] and nickel [II] and the like, but are not limited thereto.

These materials can be employed alone or in combination.

Suitable substrates for use in the recording material of the present invention include transparent sheets having a refractive index of from about 1.45 to about 1.60. Specific examples of such sheets include films of polyesters such as polyethylene terephthalate and polybutylene terephthalate; films of cellulose derivatives such as cellulose triacetate; films of polyolefins such as polypropylene and polyethylene; polystyrene films; and complex films in which two or more of these films are laminated with each other.

The recording material of the present invention preferably includes an adhesive layer between the substrate and the recording layer. Suitable materials for use in the adhesive layer include acrylic resins, saturated polyester resins, crosslinked acrylic resins and crosslinked polyester resins.

The recording material of the present invention can be used as block copies for various types of printing. Therefore the surface of the recording material is preferably lubricating. The lubricating properties can be achieved by making the surface of the recording material have a relatively low coefficient of dynamic friction or surface roughness of from 1 to 4 μm, for example, by forming an overcoat layer including a lubricant such as organic fillers, e.g., particulate silicone resins, on the top of the recording material.

The overcoat layer of the recording material of the present invention can also improve various properties of the recording material such as resistance to chemicals and water, resistance to rubbing, and resistance to light.

Next, the overcoat layer of the recording material of the present invention is hereinafter explained in detail.

Suitable organic fillers for use in the overcoat layer include fillers which are preferably spherical and have a volume average particle diameter (D50) of from 1 to 5 μm, and in addition preferably have oil absorption of linseed oil not less than 50 ml/100 g. More preferably, the fillers are particles of resins such as silicone resins, which have lubricating properties. Even more preferably, one or more inorganic fillers having a volume average particle diameter (D50) not greater than 0.7 μm and one or more organic fillers having a volume average particle diameter (D50) of from 1 to 5 μm are used in combination. The total content of the inorganic and organic fillers in the overcoat layer is preferably less than 50% by weight.

Specific examples of such fillers include the following:

Organic Fillers (1) Polymethyl methacrylate (PMMA) particles

MP and MX series manufactured by Soken Chemical Co., Ltd., and Technopolymer MB series manufactured by Sekisui Plastic Co., Ltd.;

(2) Silicone resin particles

Torefil series manufactured by Dow Corning-Toray Silicone Co., Ltd., and Tospearl series manufactured by Toshiba Silicone Co., Ltd.

Inorganic fillers kaolin, sintered kaolin, sintered clay, talc, calcium carbonate, titaniumoxide, zinc oxide, silica, colloidal silica, magnesium carbonate, aluminum hydroxide and zinc hydroxide.

Suitable resins for use in the overcoat layer include resins which preferably have almost the same refractive index, i.e., from 1.45 to 1.60, as the resins used in the recording layer. At this point, "almost the same refractive index" means a refractive index about 0.95 to 1.05 times that of the resin in the recording layer. For example, water-soluble resins, aqueous emulsions, hydrophobic resins, ultraviolet crosslinking resins, electron beam crosslinking resins, and resins having a blocked or grafted silicone segment can be employed as a resin in the overcoat layer.

Specific examples of the water-soluble resins include polyvinyl alcohol, modified polyvinyl alcohol, cellulose derivatives such as methyl cellulose, methoxy cellulose, hydroxyethyl cellulose and the like, casein, gelatin, polyvinyl pyrrolidone, styrene-maleic anhydride copolymers, diisobutylene-maleic anhydride copolymers, polyacrylamide, modified polyacrylamide, methyl vinyl ether-maleic anhydride copolymers, carboxyl-modified polyethylene, polyvinyl alcohol-acrylamide block copolymers, melamine-formaldehyde copolymers, urea-formaldehyde copolymers and the like.

Specific examples of the resins for aqueous emulsions and hydrophobic resins include polyvinyl acetate, polyurethane, styrene-butadiene copolymers, polyacrylic acid, polyacrylate, vinyl chloride-vinyl acetate copolymers, polybutyl methacrylate, ethylene-vinyl acetate copolymers, and the like. These resins can be employed alone or in combination, and may be crosslinked using a crosslinking agent.

Ultraviolet crosslinking resins, electron beam crosslinking resins, or resins having a blocked or grafted silicone segment are more preferable for the overcoat layer of the recording material of the present invention.

Suitable ultraviolet crosslinking resins include known monomers and oligomers (or prepolymers) which can polymerize and crosslink with ultraviolet light. Specific examples of such monomers and oligomers include (poly) ester acrylate, (poly)urethane acrylate, epoxy acrylate, polybutadiene acrylate, silicone acrylate, melamine acrylate and the like. Specific examples of the (poly) ester acrylate include reaction products of polyhydric alcohols such as 1,6-hexanediol, propylene glycol (propylene oxide) and diethylene glycol, with acrylic acid and a polybasic acid such as adipic acid, phthalic anhydride and trimellitic acid. Suitable compounds of the (poly)ester acrylate include compounds having one of the following formulas (a) to (c):

(a) Adipic acid/1,6-hexane diol/acrylic acid

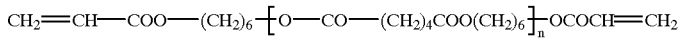

wherein n is an integer of from 1 to 10;

(b)Phthalic anhydride/propylene oxide/acrylic acid

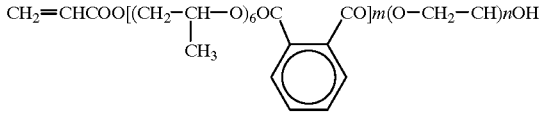

wherein b is an integer of from 1 to 10, m is an integer of from 1 to 10, and n is an integer of from 1 to 10; and (c) Trimellitic acid/diethylene glycol/acrylic acid

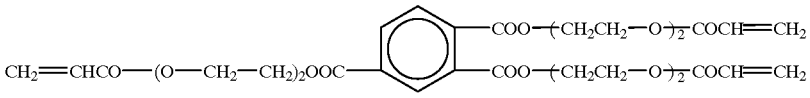

Suitable (poly)urethane acrylate compounds include reaction products of an isocyanate compound such as tolylene diisocyanate withan acrylatehavingahydroxygroup. Suitable compounds of the (poly)urethane acrylate include compounds having the following formula (d), wherein HEA represents 2-hydroxydiethyl acrylate, TDI represents tolylene diisocyanate, HDO represents 1,6-hexane diol and ADA represents adipic acid:

(d) HEA/TDI/HDO/ADA/HDO/TDI/HEA

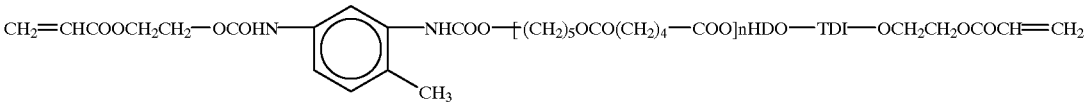

wherein n is an integer of from 1 to 10.

Epoxy acrylate compounds are broadly classified into bisphenol A type, novolak type and alicyclic type epoxy acrylate compounds. The epoxy groups of these epoxy resins are esterificated with acrylic acid so as to be changed to an acryloyl group. Suitable compounds of the epoxy acrylate compounds include compounds having one of the following formulas (e) to (g):

(e) Bisphenol A-epichlorohydrin type epoxy/acrylic acid

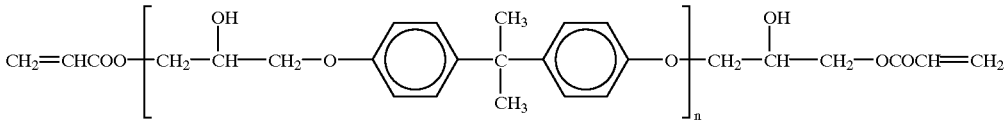

wherein n is an integer of from 1 to 15;

(f) Phenol (novolak)-epichlorohydrin type epoxy/acrylic acid

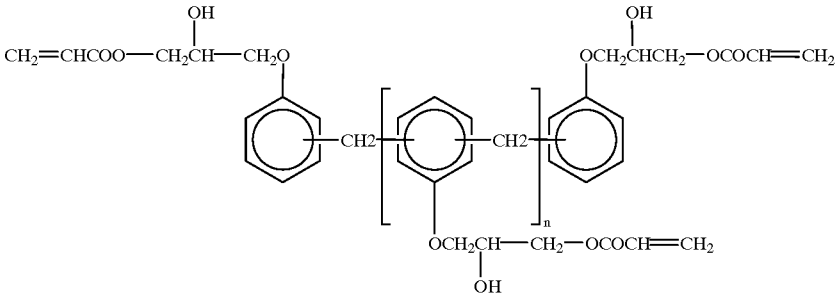

wherein n is 0 or an integer of from 1 to 5; and (g) Alicyclic type epoxy/acrylic acid

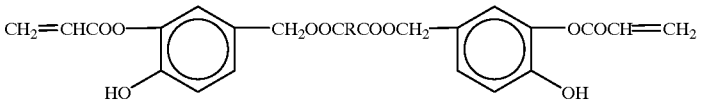

wherein R represents a group —(CH2)n—, wherein n is an integer of from 1 to 10.

Suitable polybutadiene acrylate compounds include compounds in which a reaction product of, for example, 1,2-polybutadiene having a hydroxy group at its end position with an isocyanate or 1,2-mercaptoethanol is further reacted with acrylic acid. Suitable polybutadiene acrylate compounds include compounds having the following formula (h):

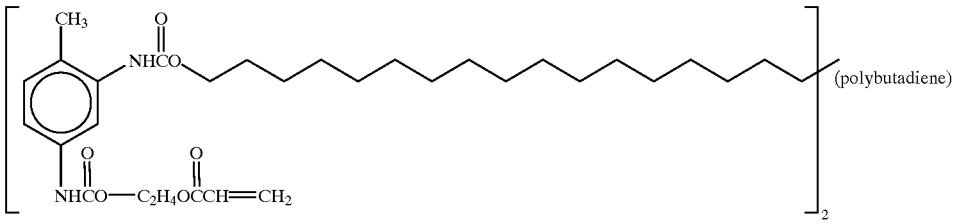

Suitable silicone acrylate compounds include compounds in which, for example, an organic functional trimethoxy silane and polysiloxane having a silanol group are subjected to a condensation reaction (demethanolization reaction) and then modified with acrylic acid. Specific examples thereof include compounds having the following formula (i):

(i)

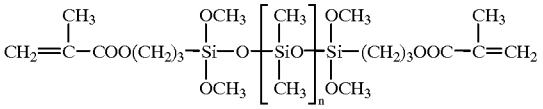

wherein n is an integer of from 10 to 14.

When ultraviolet crosslinking resins are used for the overcoat layer, solvents may be used for preparing a coating liquid. Specific examples of the solvents include tetrahydrofuran, methyl ethyl ketone, methyl isophenyl isocyanate and the like. Acrylic compounds including a double bond such as 2-hydroxyethyl (meth)acrylate, 2-hydroxypropyl (meth)acrylate, 3- hydroxypropyl (meth) acrylate can also be used. Polyesterdiol compounds in the market such as Adeka New Ace Y4–30 (manufactured by Asahi Denka Kogyo Co., Ltd.) and polyether triol compounds such as Sunnics TP-400 and GP-3000 (manufactured by Sanyo Chemical Industries Ltd.) can be used as the solvent.

The molecular weight of the polyester part of electron beam crosslinking acryl-modified polyurethane resins useful for the overcoat layer is preferably from about 2000 to about 4000, and the molecular weight of the entire acryl-modified polyurethane resins is preferably from about 20000 to about 50000, to obtain a layer having good flexibility and good toughness. In these resins, crosslinking can be accelerated, namely hardness of the resultant layer can be increased, by using acryl-modified polyurethane resins having 5 or more functional groups, and preferably from 7 to 13 functional groups.

Silicone modified electron beam crosslinking resins include compounds having the following formula:

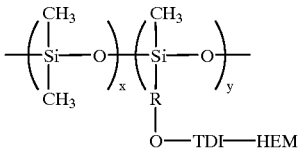

wherein R represents a group —(CH2) n—, wherein n is 0 or an integer of from 1 to 3; TDI represents 2,4-tolylenediisocyanate; HEM represents 2-hydroxyethyl acrylate; x is an integer of from 50 to 100; and y is an integer of from 3 to 6.

These electron beam crosslinking silicone resins have good film forming properties and therefore a uniform thin film can be formed, and further the resultant film has good lubricating properties because of having functional silicone groups.

The electron beam crosslinking acryl-modified polyurethane resins can be used in combination with other electron beam crosslinking acryl-modified resins. The mixing ratio of the other electron beam crosslinking acryl-modified resins to the electron beam crosslinking acryl-modified polyurethane resins is not greater than about 30/100, and preferably from about 5/100 to about 20/100.

In formation of the overcoat layer of the recording material of the present invention, electron beam crosslinking monomers having a plurality of functional groups can be preferably used to accelerate the crosslinking and to increase the heat resistance of the resultant overcoat layer.

Specific examples of such monomers include trimethylolpropane triacrylate, tetramethylolmethane tetraacryalate, pentaerythritol triacrylate, dipentaerythritol triacrylate and the like. These monomers can be mixed with the electron beam crosslinking acryl-modified polyurethane resins in an amount of not greater than about 50 parts by weight, and preferably from about 20 to about 50 parts by weight, per 100 parts by weight of the electron beam crosslinking acryl-modified polyurethane resins to maintain good lubricating properties.

Another suitable resin for use in the overcoat layer of the recording material of the present invention is phosphazene resins which have the following repeating unit:

—(P=N)—

These phosphazene resins have good heat resistance. Specific examples of such phosphazene resins include compounds having the following formula but are not limited thereto:

—[NP(A)a(B)b]n— wherein a is an integer, b is 0 or an integer and the total of a and b is 2; A represents a polymerizable and crosslinkable group such as a methacryloyloxyethyl group and the like; and B represents a group having the following formula:

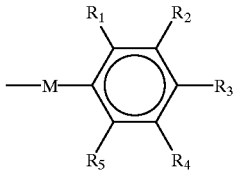

wherein $R_1$–$R_5$ independently represent a hydrogen atom, chlorine atom, a bromine atom or a halogenated alkyl group having from 1 to 4 carbon atoms; and M represents an oxygen atom, a sulfur atom or an imino group.

As for the manufacturing methods of these phosphazene resins, for example, the phosphazene resin which has a formula in which A is a methacryloyloxyethyl group and b is 0 in the formula described above can be manufactured by the ring-opening-polymerization of the following compound:

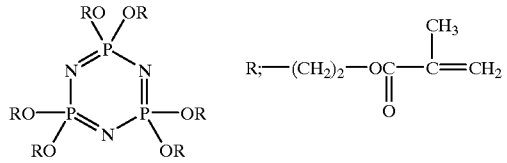

When resins have a polymerizable and crosslinkable group as the phosphazene resins described above, mechanical strength, hardness and heat resistance can be further improved by crosslinking the resins with ultraviolet light, electron beams, heating or the like.

In order to improve lubricating properties of the overcoat layer, resins with which silicone segments are block-bonded or graft-bonded are preferably used.

Suitable silicone segments to be copolymerized to the resins for use in the overcoat layer include organopolysiloxanes which include a siloxane bonding and which include an alkyl group such as methyl group bonded with a silicon atom, and which further include a reactive functional group at the end position of the molecule or in the molecule, such as a hydroxy group, a carboxyl group, an epoxy group, an amino group, a mercapto group and the like.

Suitable resins for use as main chains of the silicone grafted or blocked resins include thermoplastic resins such as poly(meth)acrylate resins, polyvinyl butyral resins, polyvinylacetoacetal resins, ethyl cellulose, methyl cellulose, acetyl cellulose, hydroxyethyl cellulose, cellulose acetate propionate, polyurethane resins, polyester resins, polyvinyl acetate resins, styrene-acrylate resins, polyolefin resins, polystyrene resins, polyvinyl chloride resins, polyether resins, polyamide resins, polycarbonate resins, polyethylene resins, polypropylene resins, polyacrylamide resins, and the like.

Among these resins, poly(meth) acrylate resins, polyvinyl butyral resins, polyvinyl acetoacetal resins, cellulose acetate propionate, ethyl cellulose and polyurethane resins are preferable because of having good heat resistance and good solubility to various solvents.

The weight ratio of the silicone segments to the silicone modified resins is from 1 to 30% by weight to obtain good lubricating properties, good resistance to sticking and good adhesiontoalayeronwhichtheovercoatlayerisformed. These silicone modified resins can be used alone as the overcoat layer or can be used as a main component thereof.

The overcoat layer can also include photostabilizers to improve the light resistance of the recording material. Suitable photostabilizers for use in the overcoat layer include the materials, which are mentioned above for use in the recording layer, such as ultraviolet absorbing agents, antioxidants, quenchers having oxygen of a singlet state, and superoxide anion type quenchers.

The recording material of the present invention can be manufactured, for example, by the following method:

(1) dispersing a color developer in an organic solvent and then adding a coloring agent and a binder resin thereto one by one, or dispersing a color developer and a coloring agent one by one in a binder resin solution in which a resin is dissolved in an organic solvent, or uniformly dispersing a color developer and a coloring agent in a binder resin solution in which a resin is dissolved in an organic solvent, to prepare a recording layer coating liquid;

(2) coating the recording layer coating liquid on one side or both sides of a transparent substrate and drying the coated liquid to form a recording layer; and (3) coating an overcoat layer coating liquid including a resin as a main component on the recording layer and drying the coated liquid to form an overcoat layer.

Suitable organic solvents for use in the recording layer coating liquid and overcoat layer coating liquid include ethers such as dibutyl ether, isopropyl ether, dioxane and tetrahydrofuran; ketones such as acetone, diethyl ketone, methyl ethyl ketone, methyl isobutyl ketone and methyl propyl ketone; esters such as ethyl acetate, isopropyl acetate, n-propyl acetate and n-butyl acetate; and aromatic hydrocarbons such as benzene, toluene and xylene. These solvents can be used alone or in combination.

Coating methods of the overcoat layer for use in the present invention are not particularly limited. The coating weight of the overcoat layer is from about 1 to about 20 $\mu$m, and preferably from about 1 to about 10 $\mu$m, to maintain good performance of the overcoat layer mentioned above and to save manufacturing cost.

The recording material of the present invention preferably includes an antistatic layer on the back side of the substrate to prevent the recording material from charging, which causes production of images having inaccurate dimension.

The antistatic layer preferably has a surface resistivity not greater than $10^8$ $\Omega/\square$, and therefore the materials for use in the antistatic layer are limited. Suitable materials for use in the antistatic layer include electroconductive metal oxides. Although electroconductive metal oxides are generally expensive, charging can be prevented even when the electroconductive metal oxide is present in the antistatic layer in a small amount. In this case the transparency of the recording material is not deteriorated.

Specific examples of such electroconductive metal oxides include SnO2, In2O3, ZnO, TiO2, MgO, Al2O3, BaO, MoO3, and complex metal oxides in which these metal oxides are mixed with P, Sb, Sn, Zn or the like, but are not limited thereto. These metal oxides preferably have a small particle diameter to make the recording material transparent. The smaller the metal oxide used in the antistatic layer, the better the transparency of the resultant recording material. The average particle diameter of metal oxides for use in the antistatic layer of the present invention is not greater than 0.2 $\mu$m to obtain a recording material having good transparency. Suitable binder resins for use in combination with the metal oxides in the antistatic layer include water-soluble resins, aqueous emulsions, hydrophobic resins, ultraviolet crosslinking resins and electron beam crosslinking resins. Specific examples of the water-soluble resins include polyvinyl alcohol, cellulose derivatives, casein, gelatin, styrene-maleic anhydride copolymers, carboxyl modified polyethylene resins and the like. Specific examples of the resins for use as the aqueous emulsions and hydrophobic resins include polyvinyl acetate, polyurethane, vinyl chloride-vinyl acetate copolymers, polyester, polybutyl acrylate, polyvinyl butyral, polyvinyl acetal, ethylene-vinyl acetate copolymers and the like. These resins can be employed alone or in combination, and may be crosslinked using a crosslinking agent.

Suitable ultraviolet crosslinking resins for use as a binder resin in the antistatic layer include known monomers, oligomers and prepolymers which can polymerize and crosslink.

Suitable electron beam crosslinking resins for use as a binder resin in the antistatic layer are not particularly limited, and preferably include electron beam crosslinking resins which have a polyester skeleton and which include a branched structure having 5 or more functional groups.

The weight ratio of the metal oxide to the binder resin in the antistatic layer is from about 0.05/1 to about 1/1, and preferably from about 0.2/1 to about 0.8/1.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example A-1

Preparation of Recording Layer Coating Liquid

The following components were mixed and dispersed in a ball mill in order that the average particle diameter of the octadecyl phosphonate was 0.3 $\mu$m. Thus a recording layer coating liquid was prepared.

Formulation of Recording Layer Coating Liquid

| | |
|---|---|
| 2-(o-chlorophenyl)amino-6-ethylamino-7-methylfluoran | 10 |
| Octadecyl phosphonate | 30 |
| SOT Red-3 (C.I. solvent red 18) (manufactured by Hodogaya Chemical Co., Ltd.) | 0.33 |
| Polyvinyl butyral (Denka Butyral #3000-2, manufactured by Denki Kagaku Kogyo K.K., refractive index of 1.49) | 15 |
| Toluene | 142.5 |
| Methyl ethyl ketone | 142.5 |

Preparation of Overcoat Layer Coating Liquid

The following components were mixed and dispersed in order that the average particle diameter of the solid components in each liquid was about 0.5 μm. Thus Liquids A and B were prepared.

Formulation of Liquid A

| | |
|---|---|
| Kaolin (UW-90, manufactured by Engelhard Corp.) | 10 |
| Silicone modified polyvinyl butyral (SP-712, manufactured by Dainichiseika Color & Chemical Mfg., Co., Ltd., solid content of 12.5%) | 8 |
| Methyl ethyl ketone | 12.5 |

Formulation of Liquid B

| | |
|---|---|
| Zinc stearate | 3.3 |
| Silicone modified polyvinyl butyral (SF-712, manufactured by Dainichiseika Color & Chemical Mfg., Co., Ltd., solid content of 12.5%) | 2.6 |
| Methyl ethyl ketone | 4.1 |

The following components were mixed and dispersed to prepare a Liquid C.

Formulation of Liquid C

| | |
|---|---|
| Silicone modified polyvinyl butyral (SP-712, manufactured by Dainichiseika Color & Chemical Mfg., Co., Ltd., solid content of 12.5%) | 80 |
| Urethane-acrylate type ultraviolet crosslinking resin (Unidick V9057, manufactured by Dainippon Ink and Chemicals Inc., solid content of 75%) | 20 |
| Particulate silicone resin (Tospearl 130, manufactured by Toshiba Silicone Co., Ltd., average particle diameter of 3 μm) | 15 |
| Silicone oil (X22-161AS, manufactured by Shin-Etsu Chemical Co., Ltd.) | 1.5 |
| Polyisocyanate compound (Colonate HL, manufactured by Nippon Polyurethane Industry Co., Ltd.) | 11.5 |
| Toluene | 100 |
| Methyl ethyl ketone | 100 |

Liquids A, B and C were mixed to prepare an overcoat layer coating liquid.

Preparation of Antistatic Layer Coating Liquid

The following components were mixed to prepare an antistatic layer coating liquid.

Formulation of Antistatic Layer Coating Liquid

| | |
|---|---|
| $SnO_2$—Sb dispersed in polyester emulsion (Colcoat SP-2002, manufactured by Colcoat Co., Ltd.) | 10 |
| Methanol | 30 |
| Water | 60 |

Preparation of Thermosensitive Recording Material

The antistatic layer coating liquid was coated with a wire bar on one side of a polyester film 100 μm thick (Merinex 705, manufactured by Dupont) and dried to form an antistatic layer about 0.3 μm thick.

The recording layer coating liquid was coated with a wire bar on the opposite side of the polyester film and dried to form a recording layer about 13 μm thick, and thereon the overcoat layer coating liquid was coated and dried, and then an ultraviolet lamp irradiated the coated overcoat layer with ultraviolet light of 80 W/cm to forma crosslinked overcoat layer 3.5 μm thick. Thus a thermosensitive recording material A-1 was prepared.

Example A-2

Preparation of Recording Layer Coating Liquid

The following components were mixed and dispersed in a ball mill in order that the average particle diameter of the octadecyl phosphonate was 0.3 μm. Thus a recording layer coating liquid was prepared.

Formulation of Recording Layer Coating Liquid

| | |
|---|---|
| 2-(o-chlorophenyl)amino-6-ethylamino-7-methylfluoran | 10 |
| Octadecyl phosphonate | 30 |
| OPLAS Red-330 (C.I. solvent red 111) (manufactured by Orient Chemical Industries Co., Ltd.) | 0.33 |
| Polyvinyl butyral (Denka Butyral #3000-2, manufactured by Denki Kagaku Kogyo K.K., refractive index of 1.49) | 15 |
| Toluene | 142.5 |
| Methyl ethyl ketone | 142.5 |

Preparation of Overcoat Layer Coating Liquid

The following components were mixed and dispersed in order that the average particle diameter of the solid components in the liquid was about 0.5 μm. Thus a Liquid A was prepared.

Formulation of Liquid A

| | |
|---|---|
| Kaolin (UW-90, manufactured by Engelhard Corp.) | 10 |
| Silicone modified polyvinyl butyral (SP-712, manufactured by Dainichiseika Color & Chemical Mfg., Co., Ltd., solid content of 12.5%) | 8 |
| Methyl ethyl ketone | 12.5 |

The following components were mixed and dispersed to prepare a Liquid B.

Formulation of Liquid B

| | |
|---|---|
| Urethane-acrylate type ultraviolet crosslinking resin (Unidick V9057, manufactured by Dainippon Ink and Chemicals Inc., solid content of 75%) | 100 |
| Particulate silicone resin (Tospearl 145, manufactured by Toshiba Silicone Co., Ltd., | 15 |

-continued

| | |
|---|---|
| average particle diameter of 4.5 μm) | |
| Silicone oil | 1.0 |
| (Byk-344, manufactured by BYK Chemie Japan Co., Ltd.) | |
| Ethyl acetate | 50 |

Liquids A and B were mixed to prepare an overcoat layer coating liquid.

Preparation of Antistatic Layer Coating Liquid

The following components were mixed to prepare an antistatic layer coating liquid.

Formulation of Antistatic Layer Coating Liquid

| | |
|---|---|
| $SnO_2$—Sb dispersed in polyester emulsion | 10 |
| (Colcoat SP-2002, manufactured by Colcoat Co., Ltd.) | |
| Methanol | 30 |
| Water | 60 |

Preparation of Thermosensitive Recording Material

The antistatic layer coating liquid was coated with a wire bar on one side of a polyester film 100 μm thick (Merinex 705, manufactured by Dupont) and dried to form an antistatic layer about 0.3 μm thick.

The recording layer coating liquid was coated with a wire bar on the opposite side of the polyester film and dried to form a recording layer about 13 μm thick, and thereon the overcoat layer coating liquid was coated and dried, and then an ultraviolet lamp irradiated the coated overcoat layer with ultraviolet light of 80 W/cm to form a crosslinked overcoat layer 4.5 μm thick (coating weight of 3.5 g/m$^2$).

Thus a thermosensitive recording material A-2 was prepared.

Example A-3

Preparation of Recording Layer Coating Liquid

The following components were mixed and dispersed in a ball mill in order that the average particle diameter of the octadecyl phosphonate was 0.3 μm. Thus a recording layer coating liquid was prepared.

Formulation of Recording Layer Coating Liquid

| | |
|---|---|
| 2-(o-chlorophenyl)amino-6-ethylamino-7-methylfluoran | 10 |
| Octadecyl phosphonate | 30 |
| SOT Pink-1 (C.I.solvent red 49) | 0.20 |
| (manufactured by Hodogaya Chemical Co., Ltd.) | |
| Polyvinyl butyral | 15 |
| (Denka Butyral #3000-2, manufactured by Denki Kagaku Kogyo K.K., refractive index of 1.49) | |
| Toluene | 142.5 |
| Methyl ethyl ketone | 142.5 |

Preparation of Overcoat Layer Coating Liquid

The following components were mixed and dispersed in order that the average particle diameter of the solid components in each liquid was about 0.5 μm. Thus Liquids A and B were prepared.

Formulation of Liquid A

| | |
|---|---|
| Urea-formaldehyde resin type organic filler | 33 |
| (manufactured by Nippon Kasei Co., Ltd.) | |
| Silicone modified polyvinyl butyral | 26 |

-continued

| | |
|---|---|
| (SP-712, manufactured by Dainichiseika Color & Chemical Mfg., Co., Ltd., solid content of 12.5%) | |
| Methyl ethyl ketone | 41 |

Formulation of Liquid B

| | |
|---|---|
| Zinc stearate | 3.3 |
| Silicone modified polyvinyl butyral | 2.6 |
| (SP-712, manufactured by Dainichiseika Color & Chemical Mfg., Co., Ltd., solid content of 12.5%) | |
| Methyl ethyl ketone | 4.1 |

The following components were mixed and dispersed to prepare a Liquid C.

Formulation of Liquid C

| | |
|---|---|
| Silicone modified polyvinyl butyral | 150 |
| (SP-712, manufactured by Dainichiseika Color & Chemical Mfg., Co., Ltd., solid content of 12.5%) | |
| Urethane-acrylate type ultraviolet crosslinking resin | 135 |
| (Unidick V9057, manufactured by Dainippon Ink and Chemicals Inc., solid content of 75% and refractive index of 1.56) | |
| Particulate silicone resin | 30 |
| (Tospearl 130, manufactured by Toshiba Silicone Co., Ltd., average particle diameter of 3 μm) | |
| Silicone oil | 1.5 |
| (SH29PA, manufactured by Shin-Etsu Chemical Co., Ltd.) | |
| Polyisocyanate compound | 20 |
| (Colonate HL, manufactured by Nippon Polyurethane Industry Co., Ltd.) | |
| Toluene | 90 |
| Methyl ethyl ketone | 90 |

Liquids A, B and C were mixed to prepare an overcoat layer coating liquid.

Preparation of Antistatic Layer Coating Liquid

The following components were mixed to prepare an antistatic layer coating liquid.

Formulation of Antistatic Layer Coating Liquid

| | |
|---|---|
| $SnO_2$—Sb dispersed in polyester emulsion | 10 |
| (Colcoat SP-2002, manufactured by Colcoat Co., Ltd.) | |
| Methanol | 30 |
| Water | 60 |

Preparation of Thermosensitive Recording Material

The antistatic layer coating liquid was coated with a wire bar on one side of a polyester film 100 μm thick (Merinex 705, manufactured by Dupont) and dried to form an antistatic layer about 0.3 μm thick.

The recording layer coating liquid was coated with a wire bar on the opposite side of the polyester film and dried to form a recording layer about 13 μm thick, and thereon the overcoat layer coating liquid was coated and dried, and then an ultraviolet lamp irradiated the coated overcoat layer with ultraviolet light of 80 W/cm to form a crosslinked overcoat layer 3.5 μm thick.

Thus a thermosensitive recording material A-3 was prepared.

Example A-4

Preparation of Recording Layer Coating Liquid

The following components were mixed and dispersed in a ball mill in order that the average particle diameter of the octadecyl phosphonate was 0.3 μm. Thus a recording layer coating liquid was prepared.

Formulation of Recording Layer Coating Liquid

| | |
|---|---|
| 2-(o-chlorophenyl)amino-6-ethylamino-7-methylfluoran | 10 |
| Octadecyl phosphonate | 30 |
| MACROLEX Redviolet R (C.I. Disperse violet 31) (manufactured by Bayer Ltd.) | 0.43 |
| Polyvinyl butyral (Denka Butyral #3000-2, manufactured by Denki Kagaku Kogyo K.K., refractive index of 1.49) | 15 |
| Toluene | 142.5 |
| Methyl ethyl ketone | 142.5 |

Preparation of Overcoat Layer Coating Liquid

The following components were mixed and dispersed in order that the average particle diameter of the solid components in the liquid was about 0.5 μm. Thus a Liquid A was prepared.

Formulation of Liquid A

| | |
|---|---|
| Kaolin (UW-90, manufactured by Engelhard Corp.) | 10 |
| Silicone modified polyvinyl butyral (SP-712, manufactured by Dainichiseika Color & Chemical Mfg., Co., Ltd., solid content of 12.5%) | 8 |
| Methyl ethyl ketone | 12.5 |

The following components were mixed and dispersed to prepare a Liquid B.

Formulation of Liquid B

| | |
|---|---|
| Urethane-acrylate type ultraviolet crosslinking resin (Unidick V9057, manufactured by Dainippon Ink and Chemicals Inc., solid content of 75% and refractive index of 1.56) | 100 |
| Particulate silicone resin (Tospearl 145, manufactured by Toshiba Silicone Co., Ltd., average particle diameter of 4.5 μm) | 15 |
| Silicone oil (Byk-344, manufactured by BYK Chemie Japan Co., Ltd.) | 1.0 |
| Ethyl acetate | 50 |

Liquids A and B were mixed to prepare an overcoat layer coating liquid.

Preparation of Antistatic Layer Coating Liquid

The following components were mixed to prepare an antistatic layer coating liquid.

Formulation of Antistatic Layer Coating Liquid

| | |
|---|---|
| $SnO_2$—Sb dispersed in polyester emulsion (Colcoat SP-2002, manufactured by Colcoat Co., Ltd.) | 10 |
| Methanol | 30 |
| Water | 60 |

Preparation of Thermosensitive Recording Material

The antistatic layer coating liquid was coated with a wire bar on one side of a polyester film 100 μm thick (Merinex 705, manufactured by Dupont) and dried to form an antistatic layer about 0.3 μm thick.

The recording layer coating liquid was coated with a wire bar on the opposite side of the polyester film and dried to form a recording layer about 13 μm thick, and thereon the overcoat layer coating liquid was coated and dried, and then an ultraviolet lamp irradiated the coated overcoat layer with ultraviolet light of 80 W/cm to forma crosslinked overcoat layer 4.5 μm thick (coating weight of 3.5 g/m$^2$).

Thus a thermosensitive recording material A-4 was prepared.

Example A-5

Preparation of Recording Layer Coating Liquid

The following components were mixed and dispersed in a ball mill in order that the average particle diameter of the octadecyl phosphonate was 0.3 μm. Thus a recording layer coating liquid was prepared.

Formulation of Recording Layer Coating Liquid

| | |
|---|---|
| 2-(o-chlorophenyl)amino-6-ethylamino-7-methylfluoran | 10 |
| Octadecyl phosphonate | 30 |
| Kayaset Red-FB R-504 (C.I. Disperse red 60) (manufactured by Nippon Kayaku Co., Ltd.) | 0.15 |
| Polyvinyl butyral (Denka Butyral #3000-2, manufactured by Denki Kagaku Kogyo K.K., refractive index of 1.49) | 15 |
| Toluene | 142.5 |
| Methyl ethyl ketone | 142.5 |

Preparation of Overcoat Layer Coating Liquid

The following components were mixed and dispersed in order that the average particle diameter of the solid components in the liquid was about 0.5 μm. Thus a Liquid A was prepared.

Formulation of Liquid A

| | |
|---|---|
| Kaolin (UW-90, manufactured by Engelhard Corp.) | 10 |
| Silicone modified polyvinyl butyral (SP-712, manufactured by Dainichiseika Color & Chemical Mfg., Co., Ltd., solid content of 12.5%) | 8 |
| Methyl ethyl ketone | 12.5 |

The following components were mixed and dispersed to prepare a Liquid B.

Formulation of Liquid B

| | |
|---|---|
| Polyvinyl acetal resin (KS-1, manufactured by Sekisui Chemical Co., Ltd.) | 75 |
| Particulate silicone resin (Tospearl 145; manufactured by Toshiba Silicone Co., Ltd., average particle diameter of 4.5 μm) | 15 |
| Silicone oil (Byk-344, manufactured by BYK Chemie Japan Co., Ltd.) | 1.0 |
| Toluene | 337.5 |
| Methyl ethyl ketone | 337.5 |

Liquids A and B were mixed to prepare an overcoat layer coating liquid.

Preparation of Antistatic Layer Coating Liquid

The following components were mixed to prepare an antistatic layer coating liquid.

Formulation of Antistatic Layer Coating Liquid

| | |
|---|---|
| $SnO_2$—Sb dispersed in polyester emulsion (Colcoat SP-2002, manufactured by Colcoat Co., Ltd.) | 10 |
| Methanol | 30 |
| Water | 60 |

Preparation of Thermosensitive Recording Material

The antistatic layer coating liquid was coated with a wire bar on one side of a polyester film 100 μm thick (Merinex 705, manufactured by Dupont) and dried to form an antistatic layer about 0.3 μm thick.

The recording layer coating liquid was coated with a wire bar on the opposite side of the polyester film and dried to form a recording layer about 13 μm thick, and thereon the overcoat layer coating liquid was coated and dried, and then an ultraviolet lamp irradiated the coated overcoat layer with ultraviolet light of 80 W/cm to forma crosslinked overcoat layer 4.5 μm thick (coating weight of 3.5 g/m$^2$).

Thus a thermosensitive recording material A-5 was prepared.

Example A-6

Preparation of Recording Layer Coating Liquid

The following components were mixed and dispersed in a ball mill in order that the average particle diameter of the octadecyl phosphonate was 0.3 μm. Thus a recording layer coating liquid was prepared.

Formulation of Recording Layer Coating Liquid

| | |
|---|---|
| 2-(o-chlorophenyl)amino-6-ethylamino-7-methylfluoran | 10 |
| Octadecyl phosphonate | 30 |
| Oil Red (C.I. 26105) (manufactured by Tokyo Chemical Co., Ltd.) | 0.6 |
| Polyvinyl butyral (Denka Butyral #3000-2, manufactured by Denki Kagaku Kogyo K.K., refractive index of 1.49) | 15 |
| Toluene | 142.5 |
| Methyl ethyl ketone | 142.5 |

Preparation of Overcoat Layer Coating Liquid

The following components were mixed and dispersed in order that the average particle diameter of the solid components in each liquid was about 0.5 μm. Thus Liquids A and B were prepared.

Formulation of Liquid A

| | |
|---|---|
| Kaolin (UW-90, manufactured by Engelhard Corp.) | 10 |
| Silicone modified polyvinyl butyral (SP-712, manufactured by Dainichiseika Color & Chemical Mfg., Co., Ltd., solid content of 12.5%) | 8 |
| Methyl ethyl ketone | 12.5 |

Formulation of Liquid B

| | |
|---|---|
| Zinc stearate | 3.3 |
| Silicone modified polyvinyl butyral (SP-712, manufactured by Dainichiseika Color & Chemical Mfg., Co., Ltd., solid content of 12.5%) | 2.6 |
| Methyl ethyl ketone | 4.1 |

The following components were mixed and dispersed to prepare a Liquid C.

Formulation of Liquid C

| | |
|---|---|
| Silicone modified polyvinyl butyral (SP-712, manufactured by Dainichiseika Color & Chemical Mfg., Co., Ltd., solid content of 12.5%) | 80 |
| Urethane-acrylate type ultraviolet crosslinking resin (Unidick V9057, manufactured by Dainippon Ink and Chemicals Inc., solid content of 75% and refractive index of 1.56) | 20 |
| Particulate silicone resin (Tospearl 130, manufactured by Toshiba Silicone Co., Ltd., average particle diameter of 3 μm) | 15 |
| Silicone oil (X22-161AS, manufactured by Shin-Etsu Chemical Co., Ltd.) | 1.5 |
| Polyisocyanate compound (Colonate HL, manufactured by Nippon polyurethane Industry Co., Ltd.) | 11.5 |
| Toluene | 100 |
| Methyl ethyl ketone | 100 |

Liquids A, B and C were mixed to prepare an overcoat layer coating liquid.

Preparation of Antistatic Layer Coating Liquid

The following components were mixed to prepare an antistatic layer coating liquid.

Formulation of Antistatic Layer Coating Liquid

| | |
|---|---|
| $SnO_2$—Sb dispersed in polyester emulsion (Colcoat SP-2002, manufactured by Colcoat Co., Ltd.) | 10 |
| Methanol | 30 |
| Water | 60 |

Preparation of Thermosensitive Recording Material

The antistatic layer coating liquid was coated with a wire bar on one side of a polyester film 100 μm thick (Merinex 705, manufactured by Dupont) and dried to form an antistatic layer about 0.3 μm thick.

The recording layer coating liquid was coated with a wire bar on the opposite side of the polyester film and dried to form a recording layer about 13 μm thick, and thereon the overcoat layer coating liquid was coated and dried, and then an ultraviolet lamp irradiated the coated overcoat layer with ultraviolet light of 80 W/cm to form a crosslinked overcoat layer 3.5 μm thick.

Thus a thermosensitive recording material A-6 was prepared.

Comparative Example A-1

The procedure for preparation of the thermosensitive recording material in Example A-1 was repeated except that the light-heat converting agent, SOT Red-3, was eliminated from the recording layer coating liquid. Thus a comparative thermosensitive recording material was prepared.

Figure 2:
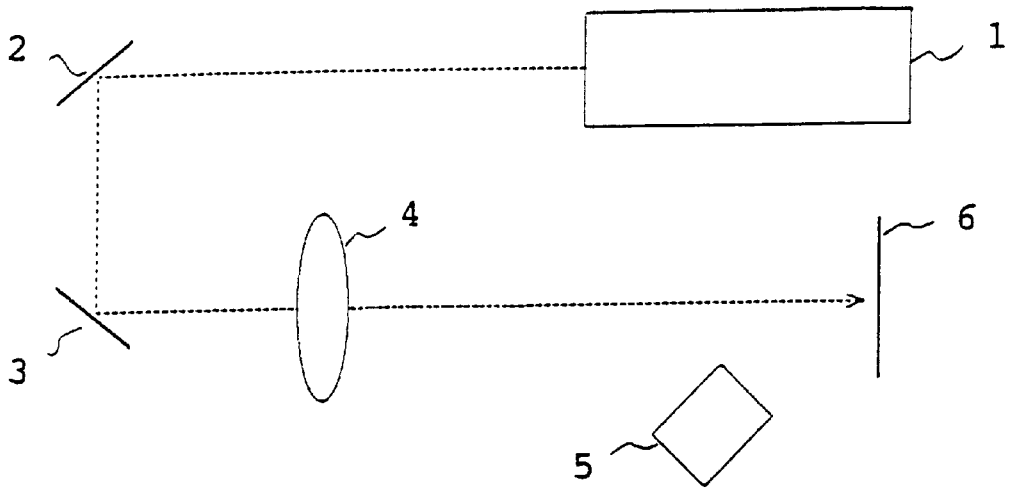
FIG. 2 is a schematic view illustrating an embodiment of image writing apparatus using a laser for use in the present invention.

Each thermosensitive recording material of Examples A-1 to A-6 and Comparative Example A-1 was set in a thermal image forming apparatus using a laser as a writing medium, a schematic view of which is illustrated in FIG. 2, and images were formed on the recording material. In FIG. 2, numeral 1 represents a laser generator which radiates light of a YAG-SHG laser having a wavelength of 532 nm, numerals 2 and 3 represent mirrors, and numerals 4, 5 and 6 represent a lens (f=100 mm), a photo diode and a thermosensitive recording material, respectively. The recording conditions were as follows:

Output power of laser (YAG-SHG 532 nm): 200 mW

Pulse width of laser light: 100 ns

Diameter of laser spot: 100 μm

This apparatus used a filter which did not absorb light of from 360 to 420 nm.

The recorded materials were visually observed to determine whether images were recorded, and then the image density and ground density thereof were measured with a transmittance densitometer X-Rite 309 (manufactured by X-Rite COMPANY) in a UV mode. In addition, the diameter of dots constituting the images were visually observed using a microscope of 100 power magnification.

The results are shown in Table 4.

In addition, when the spectral transmittance of each recording material was measured, each recording material had transmittance not less than 10% in the entire range of from 360 to 420 nm.

TABLE 4

| | Presence of recorded image | Diameter of dots | Optical density measure using UV light: Ground density | Optical density measure using UV light: Image density |
|---|---|---|---|---|
| Example A-1 | Yes | about 10 μm | 0.19 | 3.04 |
| Example A-2 | Yes | about 10 μm | 0.20 | 3.18 |
| Example A-3 | Yes | about 10 μm | 0.19 | 3.07 |
| Example A-4 | Yes | about 10 μm | 0.19 | 3.23 |
| Example A-5 | Yes | about 10 μm | 0.18 | 2.93 |
| Example A-6 | Yes | about 10 μm | 0.19 | 3.01 |
| Comparative Example A-1 | No | — | 0.18 | |

Application Examples A-1–A-7

The recording materials having images thereon were used as positive films (block copies) for screen printing to prepare printing plates (gauzes) for screen printing. In addition, printing was performed using the plates and a simple stencil duplicator to evaluate the printing qualities of the printed copies, namely to evaluate the image qualities of the block copies.

Further two block copies of each recording material were laid overlapping with each other to determine whether the overlaid images can be correctly checked (an evaluation item hereinafter termed "overlapped images checkability").

The results are shown in Table 5.

TABLE 5

| | Material of block copy | Printing qualities | Overlapped images checkability |
|---|---|---|---|
| Application Example A-1 | Recording material of Example A-1 | good | good |
| Application Example A-2 | Recording material of Example A-2 | good | good |
| Application Example A-3 | Recording material of Example A-3 | good | good |
| Application Example A-4 | Recording material of Example A-4 | good | good |
| Application Example A-5 | Recording material of Example A-5 | good | good |
| Application Example A-6 | Recording material of Example A-6 | — | — |
| Application Example A-7 | Recording material of Comparative Example A-1 | | |

As can be understood from Tables 4 and 5, the recording materials of the present invention can record good images with a YAG:SHG laser (wavelength of 532 nm) because of having light-heat converting properties in which absorbance has a peak value at a wavelength of from 500 to 550 nm and there is little absorption in a wavelength range of from 360 to 420 nm, and the resultant images can be used as block copies useful for printing.

Example B-1

Preparation of Recording Layer Coating Liquid

The following components were mixed and dispersed in a ball mill in order that the average particle diameter of the octadecyl phosphonate was 0.3 μm. Thus a recording layer coating liquid was prepared.

Formulation of Recording Layer Coating Liquid

| | |
|---|---|
| 2-(o-chlorophenyl)amino-6-ethylamino-7-methylfluoran | 10 |
| Octadecyl phosphonate | 30 |
| Cyanine compound (NK-1144, manufactured by Nippon Photosensitive Dyes Co., Ltd.) | 0.16 |
| Polyvinyl butyral (Denka Butyral #3000-2, manufactured by Denki Kagaku Kogyo K.K., refractive index of 1.49) | 15 |
| Toluene | 142.5 |
| Methyl ethyl ketone | 142.5 |

Preparation of Overcoat Layer Coating Liquid

The following components were mixed to prepare an overcoat layer coating liquid.

Formulation Overcoat Layer Coating Liquid

| | |
|---|---|
| Urethane-acrylate type ultraviolet crosslinking resin (Unidick V-9057, manufactured by Dainippon Ink & Chemicals Inc., solid content of 75% and refractive index of 1.56) | 100 |
| Silicone oil (Byk-344, manufactured by BYK Chemie Japan Co., Ltd.) | 1 |
| Ethyl acetate | 50 |

Preparation of Antistatic Layer Coating Liquid

The following components were mixed to prepare an antistatic layer coating liquid.

Formulation of Antistatic Layer Coating Liquid

| | |
|---|---|
| $SnO_2$—Sb dispersed in polyester emulsion (Colcoat SP-2002, manufactured by Colcoat Co., Ltd.) | 10 |
| Methanol | 30 |
| Water | 60 |

Preparation of Thermosensitive Recording Material

The antistatic layer coating liquid was coated with a wire bar on one side of a polyester film 100 μm thick (Merinex 705, manufactured by Dupont) and dried to form an antistatic layer about 0.3 μm thick.

The recording layer coating liquid was coated with a wire bar on the opposite side of the polyester film and dried to form a recording layer about 13 μm thick, and thereon the overcoat layer coating liquid was coated and dried, and then an ultraviolet lamp irradiated the coated overcoat layer with ultraviolet light of 80 W/cm to form a crosslinked overcoat layer about 3.0 μm thick (coating weight of 3.7 g/m$^2$).

Thus a thermosensitive recording material B-1 was prepared.

Example B-2

Preparation of Recording Layer Coating Liquid

The following components were mixed and dispersed in a ball mill in order that the average particle diameter of the α-hydroxyoctadecyl phosphonate was 0.3 μm. Thus a recording layer coating liquid was prepared.

Formulation of Recording Layer Coating Liquid

| | |
|---|---|
| 2-(o-chlorophenyl)amino-6-ethylamino-7-methylfluoran | 10 |
| α-hydroxyoctadecyl phosphonate | 30 |
| Polymethine compound (IR-820B, manufactured by Nippon Kayaku Co., Ltd.) | 0.10 |
| Polyvinyl butyral (Denka Butyral #3000-2, manufactured by Denki Kagaku Kogyo K.K., refractive index of 1.49) | 15 |
| Toluene | 142.5 |
| Methyl ethyl ketone | 142.5 |

Preparation of Overcoat Layer Coating Liquid

The following components were mixed to prepare an overcoat layer coating liquid.

Formulation Overcoat Layer Coating Liquid

| | |
|---|---|
| Polyvinyl acetal resin (S-lec KS-1, manufactured by Sekisui Chemical Co., Ltd.) | 100 |
| Particulate silicone resin (Tospearl 130, manufactured by Toshiba Silicone Co., Ltd., average particle diameter of 3 μm) | 15 |
| Silicone oil (Byk-344, manufactured by BYK Chemie Japan Co., Ltd.) | 1 |
| Methyl ethyl ketone | 900 |

Preparation of Antistatic Layer Coating Liquid

The following components were mixed to prepare an antistatic layer coating liquid.

Formulation of Antistatic Layer Coating Liquid

| | |
|---|---|
| $SnO_2$—Sb dispersed in polyester emulsion (Colcoat SP-2002, manufactured by Colcoat Co., Ltd.) | 10 |
| Methanol | 30 |
| Water | 60 |

Preparation of Thermosensitive Recording Material

The antistatic layer coating liquid was coated with a wire bar on one side of a polyester film 100 μm thick (Merinex 705, manufactured by Dupont) and dried to form an antistatic layer about 0.3 μm thick.

The recording layer coating liquid was coated with a wire bar on the opposite side of the polyester film and dried to form a recording layer about 13 μm thick, and thereon the overcoat layer coating liquid was coated and dried to form an overcoat layer about 2.0 μm thick (coating weight of 2.4 g/m$^2$).

Thus a thermosensitive recording material B-2 was prepared.

Comparative Example B-1

The procedure for preparation of the thermosensitive recording material in Example B-1 was repeated except that the light-heat converting agent NK-3555 was eliminated form the recording layer coating liquid.

Thus a comparative thermosensitive recording material B-1 was prepared.

Figure 3:
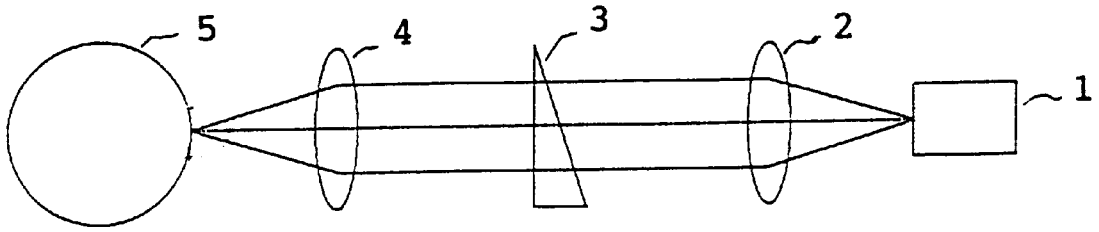
FIG. 3 is a schematic view illustrating another embodiment of image writing apparatus using a laser for use in the present invention.

Each thermosensitive recording material of Examples B-1 and B-2 and Comparative Example B-1 was set in a thermal image forming apparatus, whose schematic view is illustrated in FIG. 3, and images were formed using a laser as a writing medium. In FIG. 3, numerals 1, 2, 3, 4, and 5 respectively represent a laser diode (single mode, wave length of 830 nm and power of 100 mW), a collimator lens, a beam shaping prism, a focusing lens, and a drum on which a recording material was set. The recording conditions were as follows:

Output power of laser (GaAs 830 nm): 40 mW

Pulse width of laser light: 123 μs

Recording speed: 134 mm/sec

Cycle time of recording a dot: 125 μs

Dot density: 60 dot/mm

Diameter of laser spot: 3 μm

Focal Depth of laser spot: ±5 μm

The images were evaluated in the same way as mentioned above.

The results are shown in Table 6.

In addition, when the spectral transmittance of each recording material was measured, each recording material had transmittance not less than 10% in the entire range of from 360 to 420 nm.

TABLE 6

| | Presence of recorded image | Diameter of dots | Optical density measure using UV light: Ground density | Optical density measure using UV light: Image density |
|---|---|---|---|---|
| Example B-1 | Yes | about 10 μm | 0.17 | 3.36 |
| Example B-2 | Yes | about 10 μm | 0.15 | 3.19 |
| Comparative Example B-1 | No | — | 0.16 | — |

Application Examples B-1–B-3

The procedures for preparation and evaluation of plates (gauzes) in Application Examples A-1 to A-7 were repeated except that the recording materials were changed to Examples B-1 and B-2, and Comparative Example B-1.

The results are shown in Table 7.

TABLE 7

| | Material of block copy | Printing qualities | Overlapped images checkability |
|---|---|---|---|
| Application Example B-1 | Example B-1 | good | good |

TABLE 7-continued

| | Material of block copy | Printing qualities | Overlapped images checkability |
|---|---|---|---|
| Application Example B-2 | Example B-2 | good | good |
| Application Example B-3 | Comparative Example B-1 | — | — |

As can be understood from Tables 6 and 7, the recording materials of the present invention can record good images with a GaAs semiconductor laser (wavelength of 830 nm) because of having light-heat converting properties in which absorbance has a peak value at a wavelength of from 780 to 850 nm and there is little absorption in a wavelength range of from 360 to 420 nm, and the resultant images can be used as block copies useful for printing.

Example C-1

Preparation of Recording Layer Coating Liquid

The following components were mixed and dispersed in a ball mill in order that the average particle diameter of the octadecyl phosphonate was 0.3 μm. Thus a recording layer coating liquid was prepared.

Formulation of Recording Layer Coating Liquid

| | |
|---|---|
| 2-(o-chlorophenyl)amino-6-ethylamino-7-methylfluoran | 10 |
| Octadecyl phosphonate | 30 |
| Cyanine compound (NK-3555, manufactured by Nippon Photosensitive Dyes Co., Ltd.) | 0.33 |
| Polyvinyl butyral (Denka Butyral #3000-2, manufactured by Denki Kagaku Kogyo K.K., refractive index of 1.49) | 15 |
| Toluene | 142.5 |
| Methyl ethyl ketone | 142.5 |

Preparation of Overcoat Layer Coating Liquid

The following components were mixed to prepare an overcoat layer coating liquid.

Formulation Overcoat Layer Coating Liquid

| | |
|---|---|
| Urethane-acrylate type ultraviolet crosslinking resin (Unidick V-9057, manufactured by Dainippon Ink & Chemicals Inc., solid content of 75% and refractive index of 1.56) | 100 |
| Silicone oil (Byk-344, manufactured by BYK Chemie Japan Co., Ltd.) | 1 |
| Ethyl acetate | 50 |

Preparation of Antistatic Layer Coating Liquid

The following components were mixed to prepare an antistatic layer coating liquid.

Formulation of Antistatic Layer Coating Liquid

| | |
|---|---|
| $SnO_2$—Sb dispersed in polyester emulsion (Colcoat SP-2002, manufactured by Colcoat Co., Ltd.) | 10 |
| Methanol | 30 |
| Water | 60 |

Preparation of Thermosensitive Recording Material

The antistatic layer coating liquid was coated with a wire bar on one side of a polyester film 100 μm thick (Merinex 705, manufactured by Dupont) and dried to form an antistatic layer about 0.3 μm thick.

The recording layer coating liquid was coated with a wire bar on the opposite side of the polyester film and dried to form a recording layer about 13 μm thick, and thereon the overcoat layer coating liquid was coated and dried, and then an ultraviolet lamp irradiated the coated overcoat layer with ultraviolet light of 80 W/cm to form a crosslinked overcoat layer about 3.0 μm thick (coating weight of 3.7 g/m$^2$).

Thus a thermosensitive recording material C-1 was prepared.

Example C-2

Preparation of Recording Layer Coating Liquid

The following components were mixed and dispersed in a ball mill in order that the average particle diameter of the α-hydroxyoctadecyl phosphonate was 0.3 μm. Thus a recording layer coating liquid was prepared.

Formulation of Recording Layer Coating Liquid

| | |
|---|---|
| 2-(o-chlorophenyl)amino-6-ethylamino-7-methylfluoran | 10 |
| α-hydroxyoctadecyl phosphonate | 30 |
| Diimmonium compound (IRG-022, manufactured by Nippon Kayaku Co., Ltd.) | 0.33 |
| Polyvinyl butyral (Denka Butyral #3000-2, manufactured by Denki Kagaku Kogyo K.K., refractive index of 1.49) | 15 |
| Toluene | 142.5 |
| Methyl ethyl ketone | 142.5 |

Preparation of Overcoat Layer Coating Liquid

The following components were mixed and dispersed in order that the average particle diameter of the solid components in each liquid was about 0.5 μm. Thus Liquids A and B were prepared.

Formulation of Liquid A

| | |
|---|---|
| Kaolin (UW-90, manufactured by Engelhard Corp.) | 10 |
| Silicone modified polyvinyl butyral (SP-712, manufactured by Dainichiseika Color & Chemical Mfg., Co., Ltd., solid content of 12.5%) | 8 |
| Methyl ethyl ketone | 12.5 |

Formulation of Liquid B

| | |
|---|---|
| Zinc stearate | 3.3 |
| Silicone modified polyvinyl butyral (SP-712, manufactured by Dainichiseika Color & Chemical Mfg., Co., Ltd., solid content of 12.5%) | 2.6 |
| Methyl ethyl ketone | 4.1 |

The following components were mixed and dispersed to prepare Liquid C.

Formulation of Liquid C

| | |
|---|---|
| Silicone modified polyvinyl butyral (SP-712, manufactured by Dainichiseika Color & Chemical Mfg., Co., Ltd., solid content of 12.5%) | 80 |
| Urethane-acrylate type ultraviolet crosslinking resin (Unidick V9057, manufactured by Dainippon Ink and Chemicals Inc., solid content of 75% and refractive index of 1.56) | 20 |
| Particulate silicone resin (Tospearl 130, manufactured by Toshiba Silicone Co., Ltd., average particle diameter of 3 μm) | 15 |

-continued

| | |
|---|---|
| Silicone oil (X22-161AS, manufactured by Shin-Etsu Chemical Co., Ltd.) | 1.5 |
| Polyisocyanate compound (Colonate HL, manufactured by Nippon Polyurethane Industry Co., Ltd.) | 11.5 |
| Toluene | 100 |
| Methyl ethyl ketone | 100 |

Liquids A, B and C were mixed to prepare an overcoat layer coating liquid.

Preparation of Antistatic Layer Coating Liquid

The following components were mixed to prepare an antistatic layer coating liquid.

Formulation of Antistatic Layer Coating Liquid

| | |
|---|---|
| $SnO_2$—Sb dispersed in polyester emulsion (Colcoat SP-2002, manufactured by Colcoat Co., Ltd.) | 10 |
| Methanol | 30 |
| Water | 60 |

Preparation of Thermosensitive Recording Material

The antistatic layer coating liquid was coated with a wire bar on one side of a polyester film 100 μm thick (Merinex 705, manufactured by Dupont) and dried to form an antistatic layer about 0.3 μm thick.

The recording layer coating liquid was coated with a wire bar on the opposite side of the polyester film and dried to form a recording layer about 13 μm thick, and thereon the overcoat layer coating liquid was coated and dried, and then an ultraviolet lamp irradiated the coated overcoat layer with ultraviolet light of 80 W/cm to form a crosslinked overcoat layer about 3.5 μm thick.

Thus a thermosensitive recording material A-1 was prepared.

Comparative Example C-1

The procedure for preparation of thermosensitive recording material in Example C-1 was repeated except that the light-heat converting agent NK-3555 was eliminated from the recording layer coating liquid.

Thus a Comparative Example C-1 was prepared.

Figure 4:
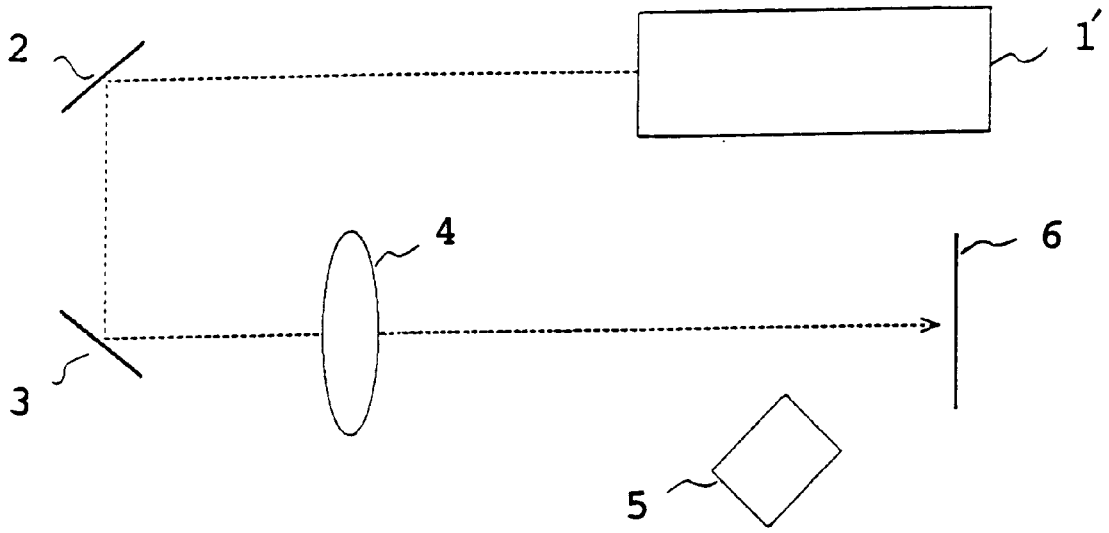
FIG. 4 is a schematic view illustrating yet another embodiment of image writing apparatus using a laser for use in the present invention.

Each thermosensitive recording material of Examples C-1 and C-2 and Comparative Example C-1 was set in a thermal image forming apparatus, whose schematic view is illustrated in FIG. 4, and images were formed using a laser as a writing medium. In FIG. 4, numerals 1', 2, 3, 4, 5 and 6 respectively represent a Nd:YAG laser generator (wave length of 1064 nm), a mirror, another mirror, a lens (f=100 mm), a photo diode and a recording material. The recording conditions were as follows:

Output power of laser (Nd:YAG 1064 nm): 200 mW

Pulse width of laser light: 100 ns

Diameter of laser spot: 100 μm

The images were evaluated in the same way as mentioned above.

The results are shown in Table 8.

In addition, when the spectral transmittance of each recording material was measured, each recording material had transmittance not less than 10% in the entire range of from 360 to 420 nm.

TABLE 8

| | Presence of recorded image | Diameter of dots | Optical density measure using UV light: Ground density | Optical density measure using UV light: Image density |
|---|---|---|---|---|
| Example C-1 | Yes | about 10 μm | 0.21 | 3.23 |
| Example C-2 | Yes | about 10 μm | 0.22 | 3.11 |
| Comparative Example C-1 | No | — | 0.19 | — |

Application Example C-1–C-3

The procedures for preparation and evaluation of plates (gauzes) in Application Examples A-1 to A-7 were repeated except that the recording materials were changed to Examples C-1 and C-2, and Comparative Example C-1.

The results are shown in Table 9.

TABLE 9

| | Material of block copy | Printing qualities | Image-checking properties |
|---|---|---|---|
| Application Example C-1 | Example C-1 | good | good |
| Application Example C-2 | Example C-2 | good | good |
| Application Example C-3 | Comparative Example C-1 | — | — |

As can be understood from Tables 8 and 9, the recording materials of the present invention can record good images with a Nd:YAG laser (wavelength of 1064 nm) because of having light-heat converting properties in which absorbance has a peak value at a wavelength of from 900 to 1150 nm and there is little absorption in a wavelength range of from 360 to 420 nm, and the resultant images can be used as block copies useful for printing.

Additional modifications and variations of the present invention are possible in light of the above teachings. It is therefore to be understood that within the scope of the appended claims the invention maybe practiced other than as specifically described herein.

This application is based on Japanese Patent Applications Nos. 09-309434, 10-024048 and 10-126622, filed on Oct. 27, 1997, Jan. 22, 1998 and Apr. 22, 1998, respectively, the entire contents of which are herein incorporated by reference.

What is claimed is:

1. A thermosensitive recording material comprising a transparent substrate; a thermosensitive recording layer which is formed overlying the substrate and which comprises an electron donating coloring agent, an electron accepting color developer and a binder resin; and an overcoat layer which is formed overlying the recording layer and which comprises a binder resin which has substantially the same refractive index as the recording layer, wherein at least one of the recording layer and a layer adjacent to the recording layer comprises a light-heat converting agent and the recording material has transmittance not less than about 10% in a range of from about 360 to about 420 nm in wavelength.

2. The thermosensitive recording material according to claim 1, wherein the recording material has light absorbing properties in which absorbance has a peak value at a wavelength of from about 500 to about 550 nm.

3. The thermosensitive recording material according to claim 1, wherein the recording material has light absorbing properties in which absorbance has a peak value at a wavelength of from about 780 to about 850 nm.

4. The thermosensitive recording material according to claim 1, wherein the recording material has light absorbing properties in which absorbance has a peak value at a wavelength of from about 900 to about 1150 nm.

5. The thermosensitive recording material according to claim 1, wherein the light-heat converting agent comprises a compound selected from the group consisting of C.I. Solvent red 18, C.I. Solvent red 49, C.I. Solvent red 111, C.I. Disperse Violet 31, C.I. Disperse Red 60 and C.I. 26105.

6. The thermosensitive recording material according to claim 1, wherein the light-heat converting agent can be compatible with or dye the recording layer or the layer adjacent to the recording layer.

7. The thermosensitive recording material according to claim 1, wherein the binder resin in the recording layer has at least one of a hydroxy group and a carboxyl group and the electron donating coloring agent comprises a compound having at least one of the following formulas (I) and (II):

(I)

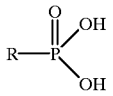

wherein R represents a linear alkyl group having from 16 to 24 carbon atoms; and (II)

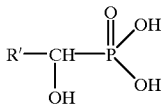

wherein R' represents a linear alkyl group having from 13 to 23 carbon atoms.

8. An image recording method comprising the steps of:

providing a thermosensitive recording material comprising a transparent substrate, a thermosensitive recording layer which is formed overlying the substrate and which comprises an electron donating coloring agent, an electron accepting color developer and a binder resin, and an overcoat layer which is formed overlying the recording layer and which comprises a binder resin which has substantially the same refractive index as the recording layer, wherein at least one of the recording layer and a layer adjacent to the recording layer comprises a light-heat converting agent and the recording material has transmittance not less than about 10% in a range of from about 360 to about 420 nm in wavelength, and irradiating the recording material with a laser to form an image on the recording material.

9. The image recording method according to claim 8, wherein the laser has a wavelength of from about 500 to about 550 nm and the recording material has light absorbing properties in which absorbance has a peak value at a wavelength of from about 500 to about 550 nm.

10. The image recording method according to claim 9, wherein the laser is a YAG-SHG laser.

11. The image recording method according to claim 8, wherein the laser has a wavelength of from about 780 to about 850 nm and the recording material has light absorbing properties in which absorbance has a peak value at a wavelength of from about 780 to about 850 nm.

12. The image recording method according to claim 8, wherein the laser is a Nd:YAG laser and the recording material has light absorbing properties in which absorbance has a peak value at a wavelength of from about 900 to about 1150 nm.

13. A block copy for flexography, gravure printing, offset printing and screen printing in which images are formed on a thermosensitive recording material by irradiating a laser to the thermosensitive recording material, wherein the recording material comprises a transparent substrate, a thermosensitive recording layer which is formed overlying the substrate and which comprises an electron donating coloring agent, an electron accepting color developer and a binder resin, and an overcoat layer which is formed overlying the recording layer and which comprises a binder resin which has substantially the same refractive index as the recording layer, and wherein at least one of the recording layer and a layer adjacent to the recording layer comprises a light-heat converting agent and the recording material has transmittance not less than about 10% in a range of from about 360 to about 420 nm in wavelength.

14. The block copy according to claim 13, wherein the laser has a wavelength of from about 500 to about 550 nm and the recording material has light absorbing properties in which absorbance has a peak value at a wavelength of from about 500 to about 550 nm.

15. The block copy according to claim 13, wherein the laser has a wavelength of from about 780 to about 850 nm and the recording material has light absorbing properties in which absorbance has a peak value at a wavelength of from about 780 to about 850 nm.

16. The block copy according to claim 13, wherein the laser is a Nd:YAG laser and the recording material has light absorbing properties in which absorbance has a peak value at a wavelength of from about 900 to about 1150 nm.

* * * * *